United States Patent [19]

Tani et al.

[11] Patent Number: 4,627,707

[45] Date of Patent: Dec. 9, 1986

[54] COPIER WITH IMAGE EDITING FUNCTION

[75] Inventors: Tatsuo Tani, Urayasu; Akira Midorikawa, Yokohama; Masaji Ito, Ageo; Masashi Kuno, Tokyo; Masayuki Shinada, Yokohama; Hirobumi Yoshino; Yoshihiro Nakashima, both of Tokyo, all of Japan

[73] Assignee: Ricoh Company, Ltd., Tokyo, Japan

[21] Appl. No.: 745,121

[22] Filed: Jun. 17, 1985

[30] Foreign Application Priority Data

| | | | |
|---|---|---|---|
| Jun. 16, 1984 | [JP] | Japan | 59-122911 |
| Jun. 16, 1984 | [JP] | Japan | 59-122912 |
| Jun. 16, 1984 | [JP] | Japan | 59-122913 |
| Jun. 16, 1984 | [JP] | Japan | 59-122914 |
| Jun. 16, 1984 | [JP] | Japan | 59-122915 |
| Jun. 16, 1984 | [JP] | Japan | 59-122916 |
| Jun. 16, 1984 | [JP] | Japan | 59-122917 |
| Jun. 16, 1984 | [JP] | Japan | 59-122918 |
| Jun. 16, 1984 | [JP] | Japan | 59-122919 |
| Jun. 16, 1984 | [JP] | Japan | 59-122920 |
| Jun. 16, 1984 | [JP] | Japan | 59-122921 |
| Jun. 16, 1984 | [JP] | Japan | 59-122922 |
| Jun. 16, 1984 | [JP] | Japan | 59-122923 |
| Jun. 16, 1984 | [JP] | Japan | 59-122924 |
| Jun. 16, 1984 | [JP] | Japan | 59-122925 |

[51] Int. Cl.[4] ..... G03G 15/00

[52] U.S. Cl. ..... 355/14 R; 355/3 R; 355/7

[58] Field of Search ..... 355/14 R, 3 R, 7, 8, 355/11, 14 SH, 3 SH, 15, 4

[56] References Cited

U.S. PATENT DOCUMENTS

| | | | |
|---|---|---|---|
| 4,268,164 | 5/1981 | Yajima et al. | 355/7 X |
| 4,322,157 | 3/1982 | Miura et al. | 355/7 X |
| 4,371,898 | 2/1983 | Nakamura | 355/7 X |
| 4,521,096 | 6/1985 | Suganuma et al. | 355/7 X |

*Primary Examiner*—A. C. Prescott

*Attorney, Agent, or Firm*—Oblon, Fisher, Spivak, McClelland & Maier

[57] ABSTRACT

A copier with an image editing function which extracts desired areas of a plurality of documents in an analog fashion and allows them to be edited on a single transfer sheet. The copier includes an erasing device for selectively erasing an image provided on a photoconductive element, a detaining device for temporarily detaining a transfer sheet, an image inputting device for inputting an image of an original document, and a display device for displaying an input condition. Desired areas of documents are specified and edited with the aid of displays and then copied. Where the specified areas of the documents overlap each other, one of them having priority over the other or a selected one of them is copied. The number of areas to be edited is open to choice. The specified areas are entered through editing keys and usual ten keys. The erasing device is driven by a controller which is responsive to digital signals which are derived from position setting knobs associated with two perpendicular scales. Different colors are used to in correspondence with specified areas or documents. After copying, sheets are stocked in different positions on the basis of an edited content. An image portion inside or outside a specified area is selectable.

15 Claims, 61 Drawing Figures

FIG. 8
| ADDRESS | DATA | CONTENT |
|---|---|---|
| 3000 H | $x_1$ $y_9$ | AREA a OF DOCUMENT A |
| 01 H | $x_1$ $y_{16}$ | 〃 |
| 02 H | $x_7$ $y_{16}$ | 〃 |
| 03 H | $x_7$ $y_9$ | 〃 |
| 04 H | $x_{15}$ $y_{25}$ | AREA b OF DOCUMENT A |
| 05 H | $x_{15}$ $y_{32}$ | 〃 |
| 06 H | $x_{30}$ $y_{32}$ | 〃 |
| 07 H | $x_{30}$ $y_{25}$ | 〃 |
| 08 H | $x_9$ $y_{18}$ | AREA a OF DOCUMENT B |
| 09 H | $x_9$ $y_{20}$ | 〃 |
| 0A H | $x_{17}$ $y_{20}$ | 〃 |
| 0B H | $x_{17}$ $y_{18}$ | 〃 |
| 0C H | $x_{30}$ $y_{51}$ | AREA a OF DOCUMENT C |
| 0D H | $x_{30}$ $y_{60}$ | 〃 |
| 0E H | $x_{50}$ $y_{60}$ | 〃 |
| 0F H | $x_{50}$ $y_{51}$ | 〃 |
| 3010H | $x_{80}$ $y_{26}$ | AREA a OF DOCUMENT D |
| 11H | | 〃 |
FIG. 9
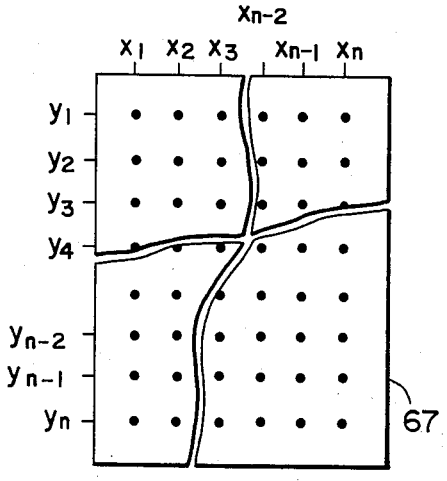
FIG. 10
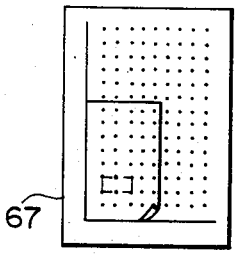

FIG. 11A
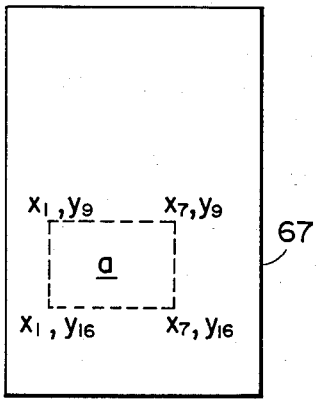
FIG. 11B
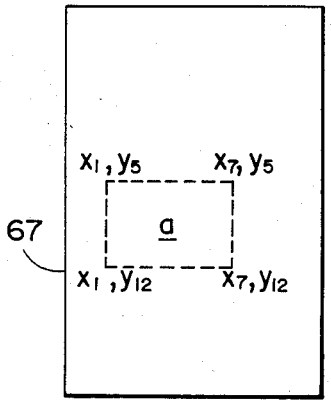
FIG. 12
| ADDRESS | DATA | CONTENT |
|---|---|---|
| 3000 H | $x_1$ $y_5$ | SHIFT OF AREA a OF DOCUMENT A |
| 01 H | $x_1$ $y_{12}$ | 〃 |
| 02 H | $x_7$ $y_{12}$ | 〃 |
| 03 H | $x_7$ $y_5$ | 〃 |
| | | |
| | | |
| | | |
| | | |

FIG. 25
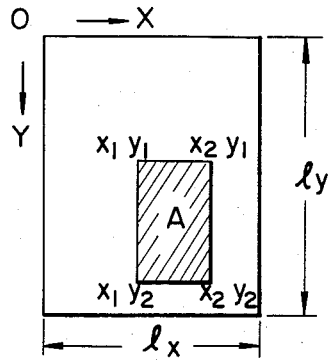
FIG. 26
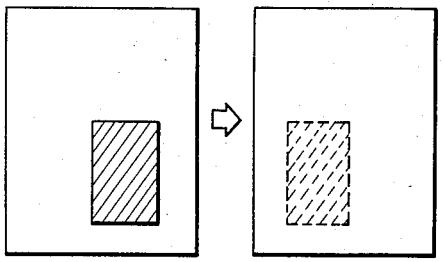
FIG. 27
| MARKED AREA DATA | | CONVERSION DATA | |
|---|---|---|---|
| $x_1$ | $y_1$ | $(x_{\ell x} - x_1)$ | $y_1$ |
| $x_2$ | $y_1$ | $(x_{\ell x} - x_2)$ | $y_1$ |
| $x_1$ | $y_2$ | $(x_{\ell x} - x_1)$ | $y_2$ |
| $x_2$ | $y_2$ | $(x_{\ell x} - x_2)$ | $y_2$ |

COPIER WITH IMAGE EDITING FUNCTION

BACKGROUND OF THE INVENTION

The present invention relates to a copier capable of extracting desired parts of a plurality of documents in an analog fasion to allow them to be edited on a single transfer sheet.

A copier with a function of picking up desired parts of documents in an analog fasion to edit them on a single transfer sheet is known in the art and have been proposed in various configurations. In a prior art copier of the type described, a first document which is partly left blank as a window for accommodating a second document and then the latter is superposed on the former to be copied to provide a single document. In another prior art copier, a copy sheet which carries a duplication of a first document is once stored in a sheet store section within the copier and, at the time of duplication of a second document, fed again to a transfer station so that a desired part of the second document may be copied on the same surface as the first document. The second-mentioned prior art copier uses relative exposure position adjusting means and erasing means in order to adequately match the positions of the respective documents.

Although the concept of editing images per ce has been known in the art of copiers of the kind described, practical techniques which enhance the operationability or practical functions associated with image editing have not been presented. In addition, the prior art copiers has a problem that a desired image area of a document cannot be set up, or marked, without using a number of switches and, therefore, without relying on an expensive construction.

SUMMARY OF THE INVENTION

It is therefore an object of the present invention to provide a copier with an image editing function which achieves an enhanced image editing function and improved operationability of a section adapted to enter data associated with a desired image area of a document.

It is another object of the present invention to provide a generally improved copier with an image editing function.

In one preferred embodiment of the present invention, there is provided a copier having an image editing function which comprises a photoconductive element and a charger for depositing a uniform electrostatic charge on the photoconductive element, an illuminating and exposing optical device for projecting an optical image of a document onto the photoconductive element, a developing device for developing an image provided on a surface of the photoconductive element, an erasing device for selectively erasing the image provided on the surface of the photoconductive element, a sheet feeding device for feeding a transfer sheet, a detaining device for temporarily detaining the transfer sheet to which the image developed by the developing device has been transferred, a discharging device for discharging the transfer sheet to which the image developed by the developing device has been transferred, a discharge path extending from a predetermined transfer station to the discharging device, a communication path for providing communication between the transfer position and the detaining device, a selector for selecting one of the discharge path and the communication path, an image inputting device for inputting an image carried on a document, a display device for displaying an input condition, and a control device for causing a copying operation to be started after specifying a desired area of a first document and, during the copying operation, specifying a desired area of a second document, and, thereby, repeatedly specifying desired areas of a plurality of documents.

In another preferred embodiment of the present invention, a control device causes desired areas of at least one document to be specified and then completely edited while displaying the desired areas on the display device for confirmation and then causes a copying operation to be started.

In another preferred embodiment of the present invention, a control device is constructed to operate such that where a first to an n-th documents are to be edited and when the documents partly overlap each other in an arrangement on a transfer sheet, a priority order is assigned to the documents so that one of overlapping portions of the documents which has priority over the other is copied.

In another preferred embodiment of the present invention, a control device is constructed to operate such that where a first to an n-th documents are to be edited and when the documents partly overlap each other in an arrangement on a transfer sheet, a content of one of the documents which is to be copied is selectable.

In another preferred embodiment of the present invention, a control device allows desired number of image editing areas to be set up.

In another preferred embodiment of the present invention, a control device causes a particular image area of a document to be specified by combined manipulation of keys for editing and ten keys for setting a number.

In another preferred embodiment of the present invention, two scales are used to position a document which are provided on a document table perpendicularly to each other. Knobs are positioned in the vicinity of the scales for defining a particular image area to be copied. Variable resistors are associated respectively with the knobs. An analog-to-digital converter converts a variation of resistance of each of the variable resistors to a digital signal. A control circuit for processes the digital signal, the erasing device being caused to glow at a timing and a position which are selected responsive to an output signal of the control circuit in correspondence with the defined image area.

In another preferred embodiment of the present invention, means for sensing a document size is provided. Area defining means for defining a desired area of a document image is also provided. A control unit controls a glowing timing and a glowing position of the erasing device, which is controlled based on a result of computation which uses position information entered through the are defining means and a document size, in conformity to values associated with the defined area when the document is laid on the document table face down.

In another preferred embodiment of the present invention, a control device is constructed to operate such that where a plurality of image areas of each of documents which are entered through the image inputting device are to be edited while being displayed on the display device, the image areas are displayed according to an order or priority which is given to overlapping portions of images and entered through the image inputting device.

In another preferred embodiment of the present invention, a control device is constructed to operate such that when a plurality of image areas of each of documents which are entered through the image inputting device are to be displayed on the display device, a plurality of image areas of a same document are displayed in colors which are associated with an order of entry of the image areas.

In another preferred embodiment of the present invention, a control device is constructed to operate such that when a plurality of image areas of each of documents which are entered through the image inputting means are displayed on the display device, the image areas are displayed in colors which respectively are associated with the documents.

In another preferred embodiment of the present invention, a control device is constructed to operate such that a plurality of contents to be edited which comprise a desired combination of specified areas are allowed to be entered simultaneously and to be copied continuously.

In another preferred embodiment of the present invention, a control device is constructed to operate such that a plurality of image areas of a same document are entered and edited contents which comprise a desired combination of the image areas are allowed to be entered and to be copied continuously.

In another preferred embodiment of the present invention, a control device allows a plurality of edited contents to be entered simultaneously and, after the plurality of edited contents have been continuously copied, causes transfer sheets to be stocked in different positions inside of a storing device on the basis of an edited content.

In another preferred embodiment of the present invention, means is provided for specifying a desired image area of a document responsive to inputs which are representative of at least four points. Means is also provided for allowing an interior and an exterior of the specified area to be selectively specified. Further, means is provided for displaying the specified area while holding the specified area in correspondence with a copy image.

The above and other objects, features and advantages of the present invention will become more apparent from the following detailed description taken with the accompanying drawings.

BRIEF DESCRIPTION OF THE DRAWINGS

FIG. 8 is a map showing a random access memory;

FIG. 9 is a schematic view of a pressure-sensitive sheet;

FIG. 10 shows a document which is laid on the pressure-sensitive sheet;

FIGS. 11A and 11B demonstrate a shift of an image area;

FIG. 12 is a map of the random access memory associated with FIGS. 11A and 11B;

FIG. 25 shows a face of document image which is to be copied;

FIG. 26 shows transition from a front face of a document to a back face of the same;

FIG. 27 shows conversion of data associated with the transition shown in FIG. 26;

DESCRIPTION OF THE PREFERRED EMBODIMENTS

While the copier with an image editing function of the present invention is susceptible of numerous physical embodiments, depending upon the environment and requirements of use, substantial numbers of the herein shown and described embodiments have been made, tested and used, and all have performed in an eminently satisfactory manner.

To better understand the present invention, a brief reference will be made to the functions of a copier to which the present invention is applicable, shown in FIGS. 1, 2 and 3.

Figure 1:
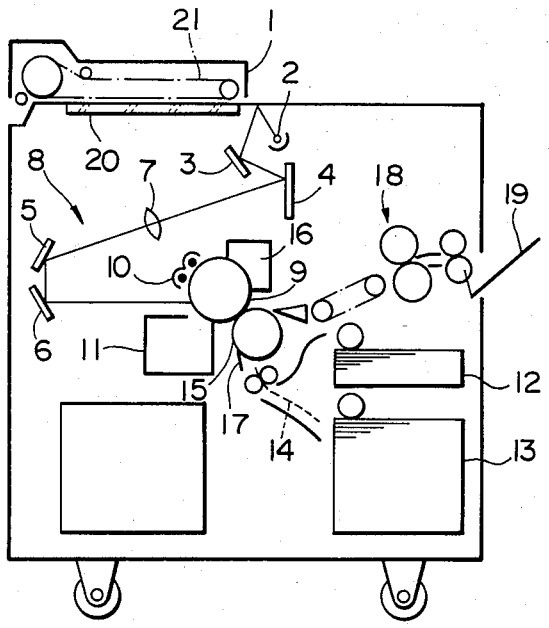
FIGS. 1 and 2 are views of internal arrangements of copiers of the type to which the present invention is applicable.

Referring to FIG. 1, an automtic document feeder (ADF), or document replacing device, 1 drives the first document to a predetermined imaging position. At this position, the first document is illuminated by optics 8 which per se is known in the art and includes a light source 2, mirrors 3–6, and a lens 7, light reflected from the document being focused to a photoconductive element 9 which may comprise a drum. The surface of the drum 9 which has been evenly charged by a charger 10 is exposed to the light to develop a latent image electrostatically thereon. While the drum 9 is moved, the latent image is developed by a developing unit 11 to become a visible image. Then, the visible image is transferred to a sheet 14 which is selectively fed out of sheet feed sections 12 and 13. In the illustrative arrangement, means for driving the sheet 14 to the transfer station is implemented by a transfer drum 15. After the image transfer, the drum 9 is discharged, then cleaned by a cleaning unit, and then caused into another copying cycle which starts with charging.

The sheet 14 carrying a duplication of the first document is fed to a detaining device which, in FIG. 1, is also implemented by the transfer drum 15. In this construction, the sheet 14 fed out of the sheet feed section 12 or 13 is once clamped by a clamp 17 which is associated with the transfer drum 15. Then, the sheet 14 rotates one full rotation clamped to the transfer drum 15 so as to receive the visible image of the first document from the drum 9 and, thereafter, it is temporarily detained on the transfer drum 15 while being spaced from the drum 9. Such a spaced position between the sheet 14 under detention and the drum 9 may be accomplished using any known implementation such as controlling the distance between the transfer drum 15 and the drum 9, or controlling the angular position of the transfer drum 15 such that a recess provided in a part of the drum 15 where a sheet is absent opposes the drum 9.

While the sheet 14 undergoes the transfer of the image of the first document and then remains detained by the drum 15 and clamp 17, the ADF 1 discharges the first document and positions a second document in the imaging position instead. Then, the drum 9 is charged and exposed as in the case with the first document. The resulting image of the second document developed on the drum 9 is transferred to the same surface of a sheet fed from the detaining device as the image of the first document; the sheet may comprise the sheet 14 which is transferred to the transfer station by rotating the transfer drum 15 again. After duplications of a third document and so on have been fully transferred to the single sheet 14 by the repetitive procedure mentioned above, the sheet 14 is unclamped, then, fixed by a fixing unit 18, and then discharged to a tray 19.

It should be noted that the ADF 1 is not restrictive and may be replaced by a manual sheet feeding arrangement or a semi-automatic sheet feeder. In the manual sheet feeding arrangement, a document on the document table 20 will be replaced with another by hand. The semi-automatic sheet feeder may be of the kind using a feed belt 21 which drives a manually inserted document to the imaging position.

In FIG. 1, the device for detaining a sheet for the period between the transfer of the first document image and that of the second document image comprises the transfer drum 15 and clamp 17. At the time of transfer of the second document image, therefore, the transfer drum 15 may be driven with a desired time lag relative to the drum 9 for the purpose of adjusting the positional deviation between the duplication of the first document and information representative of the second document with respect to the intended direction of sheet feed. In that case, to eliminate sliding motions between the drum 9 and the transfer drum 15, that part of the drum 15 which is to face the drum 9 while the drum 15 is in a halt may be recessed to avoid direct contact or, alternatively, the drum 15 may be moved away from the element 9 when in a halt.

Figure 2:
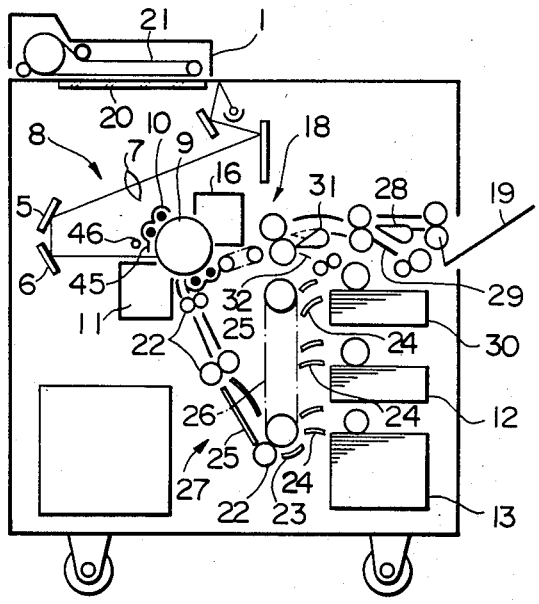

While the transfer drum 15 in FIG. 1 bifunctions as a detaining device, an independent devide for the purpose may be used such as shown in FIG. 2. In FIG. 2, sheet transport means 27 comprises rollers 22 and guides 23, 24 and 25 or a feed belt 26 and transports a sheet from the sheet feed section 12 or 13 to the transfer position. After the image transfer which is effected by known means, the sheet is fixed by the fixing unit 18 and then routed to a detention tray 30 through a detention path 29. Specifically, a first gate 28 is located to select either the detection path 29 or a path which leads to the discharge tray 19. The sheet advancing toward the detention tray 30 is always inverted such that it will be fed out of the tray 30 later with its front end positioned at the leading end; in the illustrative arrangement, the sheet is detained face down. After a transfer sheet or sheets each carrying a duplicate of the first document have been stacked on the detention tray 30, a repetitive copying cycle with a second document will be effected. In FIG. 2, the document feeding section 1, optics 8, and arrangementassociated with the drum 9 are identical with those of FIG. 1 and, therefore, detailed description thereof will be omitted.

In the event of copying the second document, feed rollers associated with the detention tray 30 or registration rollers, which are included in the sheet transport means 27 to intercept a sheet which is fed out of the tray 30 timed to exposure, are driven under timing control which is complementary to a positional deviation computed on the basis of a combining position signal and an information position signal. The adjustment is performed such that an image of the second document developed on the drum 9 just arrives at the transfer station when a particular combining position of the sheet which carries an image of the first document has reached the transfer station. The sheets are sequentially and repetitively detained on the tray 30 and fed thereoutof to the transfer station complementarily to a desired number of documents which are to be combined. Upon completion of the last copying cycle performed with the last document, the first gate 28 is actuated to the other position for routing the sheets toward the discharge tray 19.

As shown in FIG. 2, a second gate 31 may be located between the fixing unit 18 and the first gate 28 in order to selectively route sheets toward the detention tray 30 by way of a path 32. Specifically, a sheet entered the path 32 will reach the tray 30 without being inverted, that is, with the duplication faced upward and the front end positioned at the rear. Where the path 32 is selected by the second gate 31, the sheets stacked on the detension tray 30 will each make contact with the drum 9 at the other surface thereof in the course of the next copying cycle. Such makes it possible to provide a duplication on each of opposite faces of a sheet. The two gates 28 and 31 and the two different routes to the detention tray which are selectively set up by the gates 28 and 31 allow images to be combined in one surface of a sheet, or produced on opposite faces of a sheet, or even produced on opposite sides of a sheet while being combined. The third-mentioned copying mode is such that the previously mentioned image combining operation is effected on one face of a sheet and, then, the sheet is passed to the detention tray 30 through the path 32 so that the image combining operation is effected on the other face of the sheet.

Figure 3:
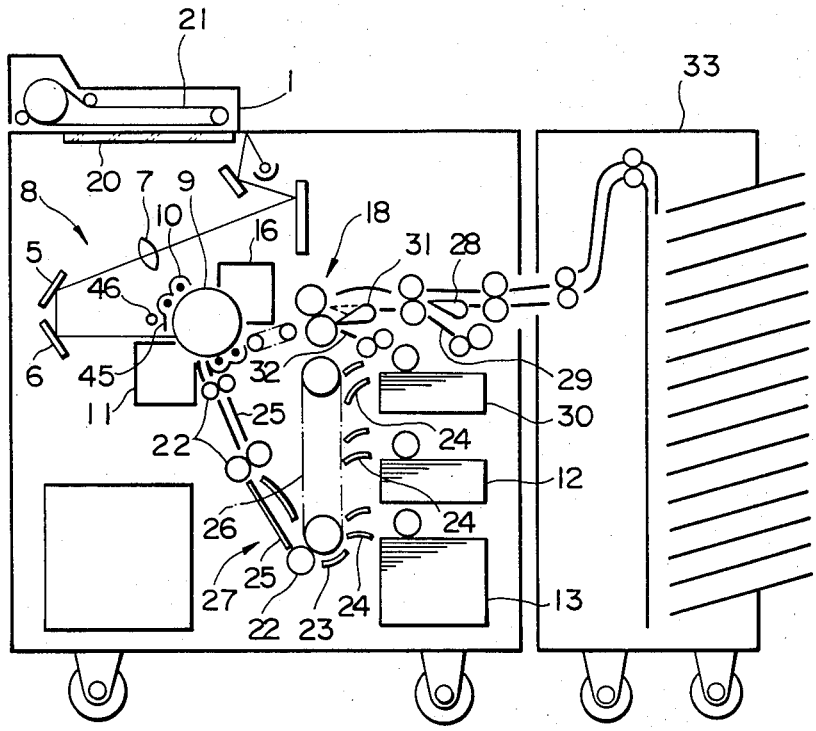
FIG. 3 is a view of the copier shown in FIG. 2 to which a sorter is operatively connected.

In FIG. 3, the reference numeral 33 designates a sorter which may be operatively connected to the copier in place of the discharge tray 19 which is shown in FIG. 2.

Figure 4:
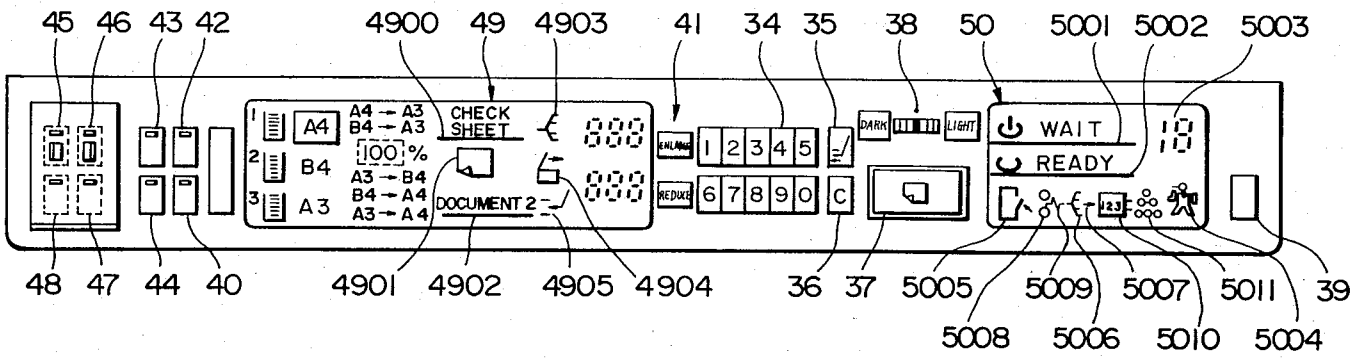
FIG. 4 is a plan view of an operating section.

Referring to FIG. 4, an operating section of a copier in accordance with the present invention is shown. Keys provided in the operating section are ten keys 34, an interrupt key 35, a clear/stop key 36, a print key 37, a density control key 38, a standard mode set key 39, a sheet feed select key 40, a magnification set key 41, double-face copy keys 42 associated respectively with one-faced documents and double-faced documents, a stack key 43, a sort key 44, a left blank key 45, a right blank key 46, an inverted discharge key 47, and a combined copy key 48. Display portions 49 and 50 become visible when lamps associated therewith are turned on. Conveniently, the keys are operated from the leftmost one to the rightmost as viewed in FIG. 4 and, therefore, their functions will be described in this order.

The left blank key 45 and the right blank key 46 are operable to adjust a binding margin of copies. To leave a binding margin of 15 millimeters at the left-hand side of each copy, one will depress the ten keys 34 to enter data "15" while depressing the left blank key 45. Then, a seven-segment display in an upper portion of the display section 49 will turn on or flash to indicate "15". When one releases the left blank key 45, the display will return from "15" to "1". The same holds true with the right blank key 46. The combined copy key 48 is used to copy the first and second documents in superposition. The inverted discharge key 47 will be despressed when one desires to discharge copies face down on the discharge tray 19. Such a discharge mode will place the first copy face down at the bottom of a stack and, therefore, the stack will have been automatically sorted when bodily positioned upside down. The stack key 43 and the sort key 44 each play a well known role which will need no explanation.

The double-face copy keys 42 are selectively operated to copy images carried on double-faced documents on opposite faces of sheets and to copy images on one-faced documents on opposite faces of sheets. The sheet feed select key 40 is adapted to select one of the sheet trays 12 and 13. In the display section 49, the first sheet tray is loaded with A4 sheets, the second sheet tray with B4 sheets, and the third sheet tray with A3 sheets. When the first sheet tray is selected, the format "A4" on the display section will be marked with a frame. As the key 40 is depressed in the condition shown in FIG. 4, the frame will shift to the second sheet tray to indicate selection of the second sheet tray. The magnification set keys 41, one assigned to enlargement and the other to reduction, are selectively operable to set up a magnification; while any of them is continuously depressed, magnifications will appear on the display 49 in percent and may vary on one percent basis. As the magnification reaches "71%", for example, "A3→A4" is also displayed to indicate that the magnification corresponds to reduction from A3 to A4. The ten keys 34 are adapted to enter a desired number of copies; the number appears in a seven-segment display in an upper part of the display section 49. The lower seven-segment display in the display section 49 shows a number of copies produced. As previously stated, the ten keys 34 are also used to select a binding margin in combination with the blank key 45 and 46. If desired, the enlargement and reduction keys 41 shown and described may be replaced with a single magnification key, in which case one may enter a desired percentage through the ten keys 34 while depressing the magnification key.

The interrupt key 35 is usable to accommodate urgent copies while a copying operation is under way; when depressed, it will interrupt the copying operation and, when depressed again after urgent copies have been produced, restore the copier to the previous mode. The clear/stop key 36, density control key 38 and print key 37 will need no detailed explanation. The standard mode set key 39 plays a role of restoring the copier to an originally set mode when depressed. For example, assuming that an A4 format, 100 percent (×1) magnification mode is present as a standard mode, one is allowed to cancel any other mode precedingly set up by another person, such as an A3 format, 71 percent reduction, double-face copy, sort mode simply by depressing the key 39.

In FIG. 4, the blank keys 45 and 46, combined copy key 48 and inverted discharge key 47 are shown as being covered because they are not frequently needed.

The other display functions assigned to the display sections 49 and 50 are as follows. A display 4900 turns on when documents and sheets are not coincident and it will naturally be actuated taking magnifications as well into account. A display 4901 turns on when sheets are absent in a selected sheet tray. a display 4902 turns on when the back of each double-faced document is to be copied. A display 4903 turns on for precausion purpose when the stack key or the sort key is depressed while sheets are present in sorter bins, thereby preventing copy sheets to be processed from being mixed with precedingly produced copy sheets. A display 4904 turns on when a document is carelessly left on the copier without being removed. A display 4905 turns on upon depression of the interrupt key 35.

Further, a display 5001 remains turned on while the copier is in a warm-up operation. A display 5002 turns on to indicate a particular condition in which the warm-up operation has been completed and the copier is ready to operate as soon as the print key 37 is depressed. A display 5003 provides a numerical indication representative of a failure in the copier and, when it is turned on, a display 5004 will also be turned on for serviceman call. The numeral in the display 5003 shows a particular failing section of the copier, fulfilling a self-dignosis function. If desired, the display 5003 may function to show a time on a minute basis during the course of the warm-up period. A display 5005 turns on when a door is open; when a door on the sorter side is open, the display 5005 and displays 5006 and 5007 turn on at the same time. Displays 5008 and 5009 turn on in the event of sheet jams; in the case of a sheet jam occurred in the sorter, the displays 5009 and 5006 will turn on. A display 5010 turns on when a key counter has not been set. A display 5011 turns on when the toner concentration in a developer has become short.

Figure 5B:
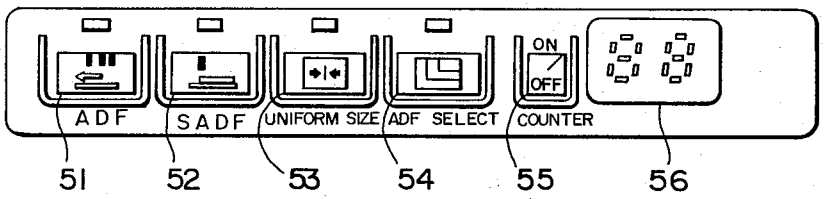
FIGS. 5A and 5B are plan views representative of a display and an operating sections associated with an automatic document feeder.
Figure 5A:
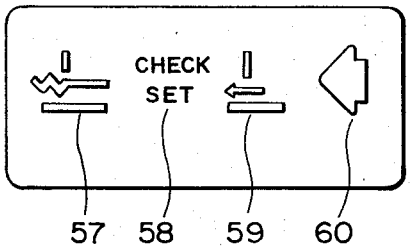

Referring to FIGS. 5A and 5B, an ADF operating section is shown. In FIG. 5B, a control panel includes an ADF key 51 adapted to automatically feed documents, and an SADF key 52 adapted for manual insertion of documents, both the keys 51 and 52 being well known in the art. A size uniformalize key 53 is used to uniformalize the size of sheets which carry duplications of documents thereon. Specifically, when depressed, the key 53 senses a document size so that a magnification which conforms to the size of sheets loaded in a selected sheet tray is automatically set up. An automatic sheet, or paper, select key (APS) 54 is used to sense a document size to automatically select sheets on a tray such that a preset magnification is set up. A counter key 55 will be depressed when the display of a number of documents is desired, the number being displayed by seven-segment, light emitting diodes (LEDs) 56.

In FIG. 5A, a display panel is shown which includes a document jam display 57, a set confirm display 58 which turns on when the set condition of a document is incomplete, a document feed display 59 which turns on when a copying operation is ready to start upon loading of a document in the SADF mode, a document insert display 60 which indicates a predetermined document inserting direction and turns off upon insertion of a document.

Hereinafter will be described a display section in accordance with the present invention. The display section is implemented by a cathode-ray tube (CRT). Information which may appear on the CRT are shown in FIGS. 6A–6G.

Figure 6A:
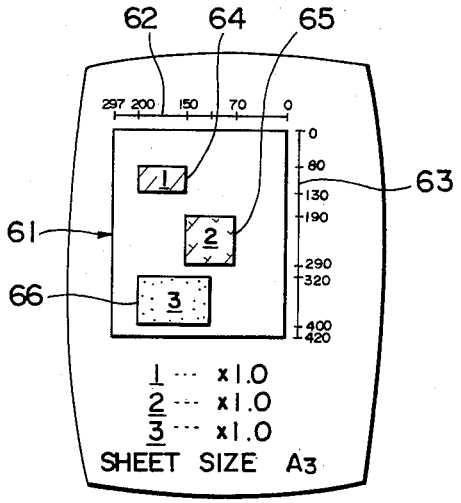
FIGS. 6A–6G are views of various conditions of the display section.

In FIG. 6A, the reference numeral 61 designates a size of sheets. Scales 62 and 63 are indicative of the dimensions of sheets in numerical values. Appearing within the sheet size are a part 64 of the first document, a part 65 of the second document, and a part 66 of the third document. Shown below the scales 62 and 63 are characters indicative of modes associated with the respective document parts as well as a sheet size.

Figure 6B:
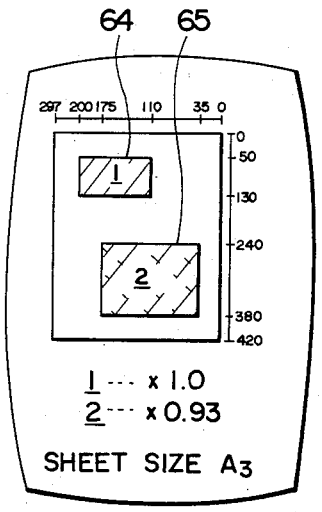

In FIG. 6B, a part of the first document is designated by the reference numeral 64 and that of the second document by the reference numeral 65. As indicated by characters, the first document is to be copied in a ×1 magnification mode, while the second document is to be copied in a 93 percent reduction mode.

Figure 6C:
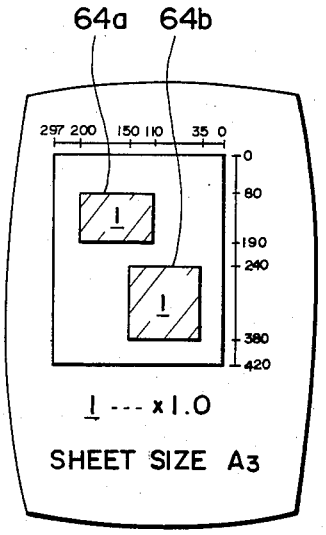

In FIG. 6C, appearing in the selected sheet size are different parts of the first (same) document.

Figure 6D:
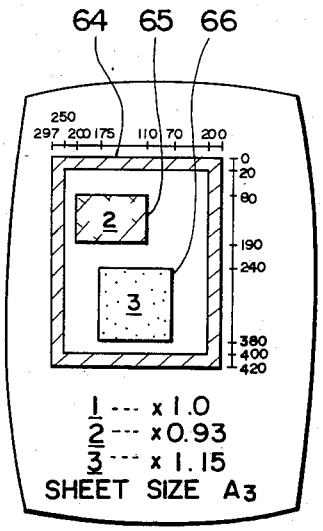

In FIG. 6D, the reference numeral 64 designates a part of the first document. In this particular example, a frame will be provided on a sheet, a part 65 of the second document will be copied in a 93 percent reduction mode, and a part 66 of the third document will be copied in a 115 percent enlargement mode, each in the illustrated position.

Figure 6E:
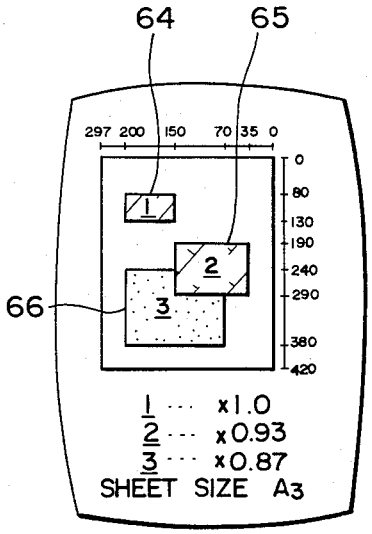

In FIG. 6E, a part 64 of the first document, a part 65 of the second document, and a part 66 of a third document are shown as appearing within the sheet size. The display shows that while the document parts 65 and 66 overlap each other, the document part 65 will be copied prior to the document part 66. 64 represents a position which a ×1 copy will assume, 65 a position which a 93 percent reduced copy will assume, and 66 a position which an 87 percent reduced copy will assume.

Figure 6F:
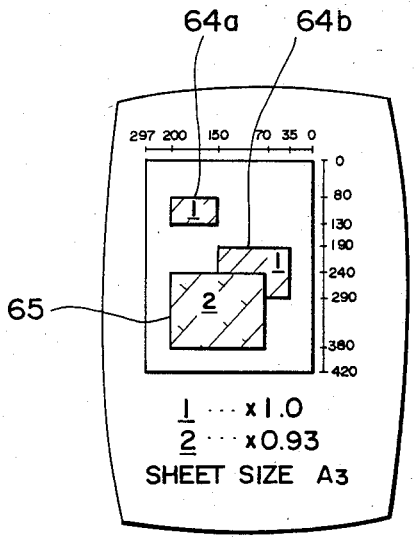

In FIG. 6F, appearing in the sheet size are different parts 64*a* and 64*b* of the first document, and a part 65 of the second document. While the document parts 64*b* and 65 overlap each other as has been the case with FIG. 6E, the latter is copied with prior to the latter.

Figure 6G:
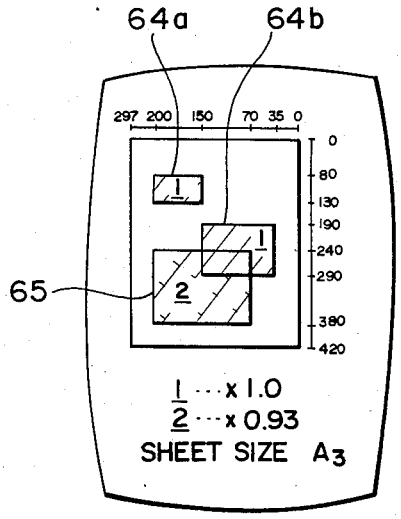

In FIG. 6G, appearing in the sheet size are different parts 64*a* and 64*b* of the first document, and a part 65 of the second document. While the document parts 64*a* and 65 overlap each other, the situation is that both of them need to be copied in accordance with the contents to be reproduced in the document parts 64*a* and 64*b*, that is, none of them has priority over the other.

Where the CRT comprises a color CRT, the document part 64 in FIG. 6A, for example, may be indicated in green, the document part 65 in yellow, and the document part 66 in red to promote the ease of perception. In the case of a monochromatic CRT, the document part 64 may be indicated by a solid line, the document part 65 by a broken line, and the document part 66 by a dash-and-dot line for the same purpose. Where priority is adopted as shown in FIGS. 6E and 6F, the document parts may be indicated in red, yellow and blue, or a solid line, a broken line and a dash-and-dot line in the priority order. In FIG. 6A, the numerals in the document parts 64, 65 and 66 are indicative of the order of documents. However, in the case of a color CRT, those numerals are omissible if red is assigned to the first document, yellow to the second document, and blue to the third document.

Figure 7:
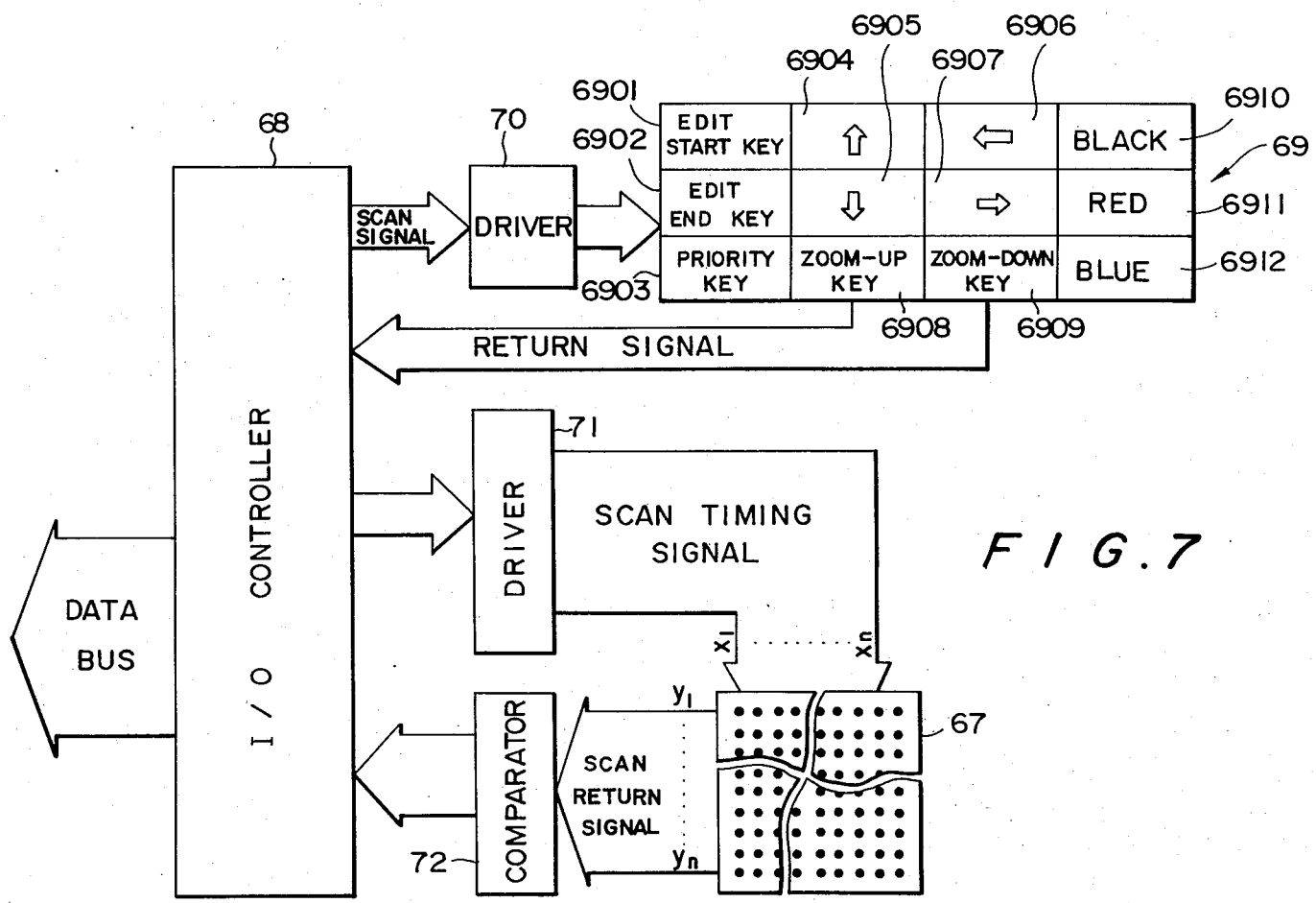
FIG. 7 is a block diagram of an image editing area input section.

Next, an operating section adapted for image editing is shown in a block diagram in FIG. 7.

Referring to FIG. 7, a pressure-sensitive sheet 67 is provided with signal lines on each of x- and y-axes for inputting and outputting respective matrix signals. Information representative of particular positions on the sheet 67 are entered reponsive to scan timing signals from an I/O controller 68, which is interconnected by a data bus to a host microcomputer which will be described. A document editing area is sensed on the basis of matrix data of scan timing signals and scan return signals associated with the pressure-sensitive sheet 67 which is depressed. A group of keys 69 interconnected to an area manipulating section comprise an edit start key 6901, an edit end key 6902, a priority key 6903, area shift keys which are an up-shift key 6904, a down-shift key 1905, a left-shift key 1906, and a right-shift key 1907, zoom keys which are a zoom-up key 6908 and a zoom-down key 6909, and color specify keys which are a black specify key 6910, a red specify key 6911 and a blue specify key 6912. Depression of a key is discriminated based on a matrix signal of return signals which are returned to the I/O controller 68 responsive to scan timing signals.

The functions assigned to the various keys in the operating section are as follows.

(1) The edit start key 6901 notifies the start of editing a document and, so long as this key is not depressed, position data associated with the pressure-sensitive sheet 67 is cancelled.

(2) The edit end key 6902 notifies the end of editing a document and, when this key is depressed, all the desired areas of a document are completely specified. Before this key is depressed, a plurality of areas of a document may be marked as desired.

(3) The priority key 6903 will be depressed where desired areas of a plurality of documents overlap each other, so as to given priority to a desired one of the documents. As this key is depressed before, after or during marking, a priority flag is set in a random access memory (RAM) which serves to store a number of documents.

(4) The area shift keys 6904–6907 are selectively depressed to shift a specified or marked area in the vertical and horizontal directions without changing the dimensions of the marked frame. Data in the y-axis direction stored in the RAM, which is shown in a map in FIG. 8, is updated and, when the shift key is released, the latest position data is written. Upon depression of the up-shift key 6904 or the down-shift key 6905, data associated with the y-axis position is updated. Likewise, upon depression of the left-shift key 6906 or the right-shift key 6907, data associated with the x-axis is updated.

(5) The zoom keys 6908 and 6909 are each operable in a stepless manner in the enlarging or reducing direction so as to change the size of images in a marked area.

(6) The color specify keys 6910–6912 may be depressed to reproduce data in a plurality of colors on a copy sheet.

(7) A pressure-sensitive sheet key is adapted to determine position data associated with the frame of a marked area and remains effective throughout a period between depression of the edit start key 6901 and that of the edit end key 6902. The data is identified based on matrix signals of x- and y-axes scan signals and scan return signals. The position is determined by scanning the whole area of $T_{xn}T_{yn}$ with the scan timing signal $T_{x1}$ and the return signal $T_{y1}$ used as position data repesentative of $x_1y_1$.

The pressure-sensitive sheet 67 with x- and y-axes are shown in FIG. 9. A transfer sheet which is laid on the sheet 67 is shown in FIG. 10. In FIG. 10, the area surrounded by a rectangle represents an area to be edited. Shown in FIGS. 11A and 11B is a shift of the marked area, a RAM map associated with the shift being shown in FIG. 12. In FIG. 7, designated by the reference numeral 70 is a driver, 71 a driver, and 72 a comparator.

Hereinafter will be described an optical illuminating section.

Factors involved in image editing include changes of images both in size and in position with respect to a copy sheet. This is accomplished by means of an optical projecting arrangement (optics) in the analog image editing copier to which the present invention pertains. In the copier shown in FIG. 1, a document laid on the document table 20 is illuminated by the light source 2 so that light reflected from the document is focused in a slit configuration onto the drum 9 by way of mirrors 3–6 and lens 7. The first mirror 3 (velocity v) and the second mirror 4 which are integral with the light source 2 scan the document, whereby the light image of the document is continuouly focused to the element 9.

A change of image size is effected by variable-magnification projection.

(i) A change of magnification in the mirror scanning direction depends upon the relationship between the surface velocity $v_0$ of the drum 9 and the velocity v of the mirror 3. Assuming that the magnification is m, then $$m = v_0/v$$

(this does not apply to an entire-surface exposure type copier such as one employing flash exposure).

(ii) In a direction perpendicular to the direction mentioned in (i), i.e., direction along the axis of the drum 9, a change of magnification is accomplished by so-called zooming.

In the example shown in FIG. 1, a fixed-focus lens is used. The objective is achieved by moving the lens 7 along the optical axis by an amount Δa which is complimentary to the magnification m and, at the same time, displacing the mirrors 5 and 6 to compensate the total path by Δ1. Assuming that the lens has a focal length f, $$\Delta a = \left(\frac{1}{m} - 1\right) f$$

$$\Delta 1 = \left(m + \frac{1}{m} - 2\right) f$$

However, where use is made of a zoom lens, the compensation of the total path is omissible.

A change in the position of an image is accomplished by the following means.

(i) Repositioning in the mirror scanning direction is effected by changing the relative position between a toner image developed on a photoconductive element and a transfer sheet at the time of image transfer, i.e. the timing for the transfer sheet 10 to make contact with the element 9 (alternatively, the timing at which the mirrors start scanning may be changed).

Figure 13:
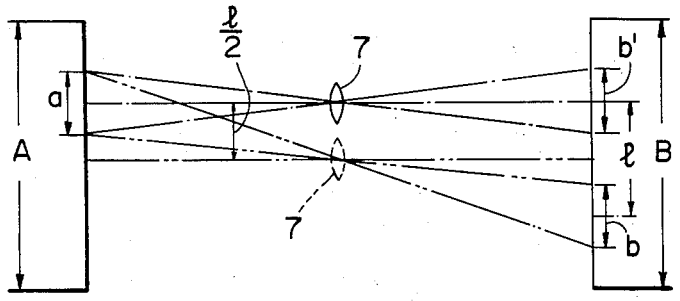
FIGS. 13–15 are diagrams showing positions of a lens adapted for image editing.

(ii) Referring to FIG. 13, an optical path which extends through the lens 7 is shown in a plan view. Where information present in a part a of a document range B is exposed, they will usually be focused to a part b of a range B of the photoconductive element, which corresponds to a copy sheet or a transfer sheet. When the lens 7 is moved 2/l perpendicularly to the optical axis, the focusing range shifts from the region b to a region b′ over a distance l in the same direction as the lens 4. This implies that by selecting an amount of displacement of the lens perpendicular to the optical axis it is possible to select an imaging position on the photoconductive element, or copy sheet, in a direction perpendicular to the moving direction of the copy sheet as desired. In addition, such may be combined with the previously mentioned movement of the lens 7 which occurs along the optical axis in order to smultaneously accomplish variable-magnification copying and combined copying. The amount of displacement of the lens perpendicular to the optical axis is determined by computing a deviation between the position of information and a specified copying position by means of a controller and controlling a lens drive device responsive to the resulting signal.

Figure 14:
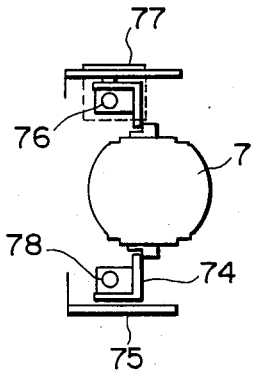
Figure 15:
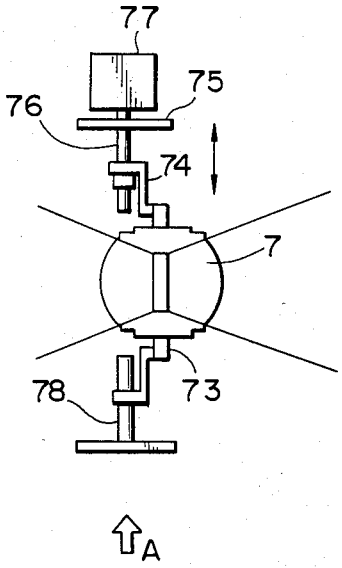

To drive the lens 7, an arrangement shown in FIGS. 14 and 15 may be used. In the illustrative arrangement, the lens 7 is rigidly mounted on a lens support 73 which in turn is supported by a lens bracket 74. The lens bracket 74 is mounted on a threaded shaft 76 which is rotatably retained by the optics frame 75. The threaded shaft 76 is reversively driven by a motor 77 with or without the intermediary of a belt or the like so as to move the lens 7 in a direction perpendicular to the optical axis. The lens bracket 74 is preferably guided by a guide bar 78 which is fixed to the frame 75, so that the lens 7 may smoothly reciprocate without tilting. For the variable-magnification copying function, the optics frame 75 itself may be supported by a threaded shaft as in FIGS. 14 and 15 to be movable along the optical axis. Another possible approach for the variation of an image position is rendering a document movable together with the document support in one direction or in two perpendicular directions, thereby allowing the document set position adjustable.

A control section is constructed as follows.

Figure 16:
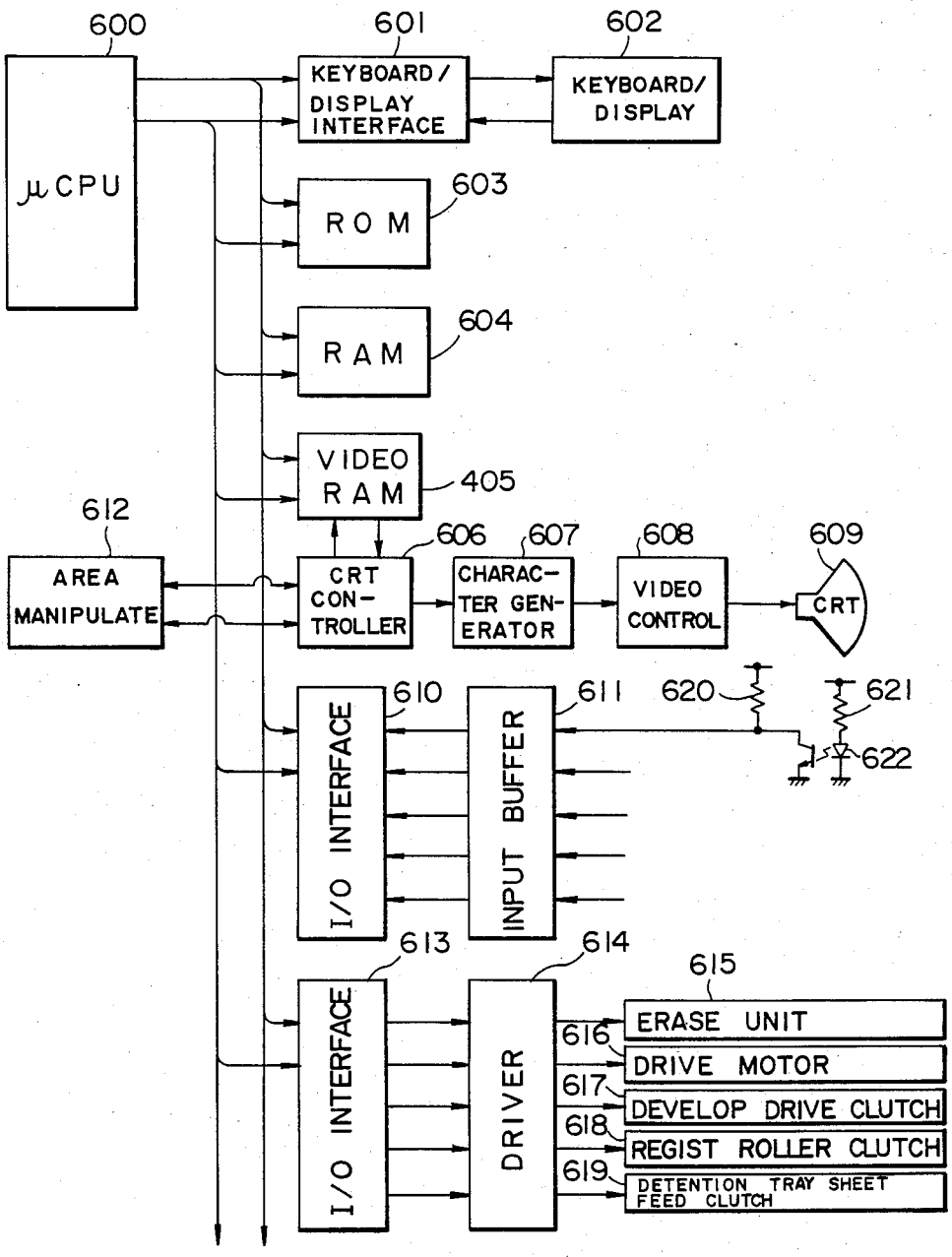
FIG. 16 is a control block diagram representative of a copier in accordance with the present invention.

Referring to FIG. 16, a control block diagram in accordance with the present invention is shown. The control section comprises a microprocessor 600, a keyboard/display interface 601, keys and displays 602 installed in the operating section, a ROM 603 storing control programs and fixed data, a RAM 604 to and from which control flags and copy data are written and read, a video RAM 605 for storing data to be displayed on a CRT, a CRT controller 606 for controlling display positions, timings and others by reading data out of the video RAM 605, a character generator 607 for converting display data to a dot pattern, a video controller 608 for converting dot data to a video signal and, at a suitable timing, applying the video signal to the CRT 609, an input/output (I/O) interface 610, a buffer 611 associated with each input in the copier, an image area manipulating section 612 for editing, an I/O interface 613, a driver 614, an erase unit 615, an optical axis moving motor 616, a development drive clutch 617, a registration roller clutch 618, a sheet feed clutch 619 associated with the detention tray, and other loads.

The entire copier is controlled as specified by the control programs which are stored in the ROM 603. The control programs are generally classified into two kinds, i.e., one for processing image editing inputs, copy mode inputs and the like (standby routine) and a program for controlling timings of copying process loads (copy routine). The image editing inputs to be processed by the standby routine are image area inputs entered through the area manipulating section and layout inputs entered through the keyboard. The erase unit 615, optical axis moving motor 616, development drive clutch 617, registration roller clutch 618 and detention tray sheet feed clutch 619, which are shown in FIG. 16 as examples of loads, are, for example, on-off controlled at timings which are controlled responsive to the above-mentioned input data.

Figure 17B:
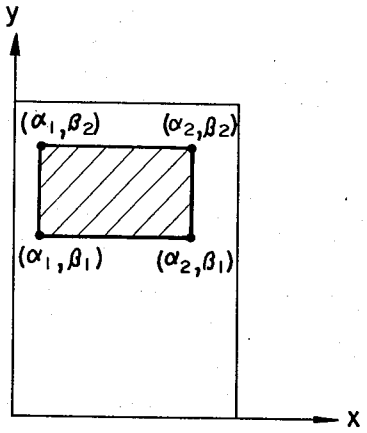
FIGS. 17A and 17B are diagrams showing image area data and image areas.
Figure 17A:
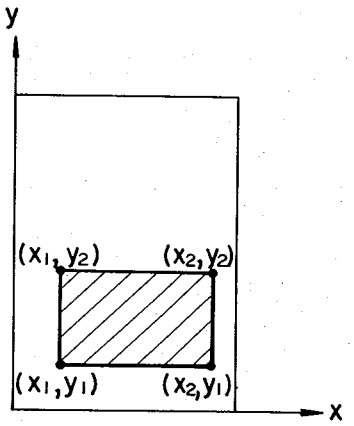

Assuming that initially entered area data is "$x_1x_2y_1y_2$", area data after layout is "$\alpha_1\alpha_2\beta_1\beta_2$", and erase data during normal copying is "$x_1x_2y_1y_2$" (see FIGS. 17A and 17B), then the erase unit 615 will be controlled by computing area data after the layout and the usual erase data, the motor 616 by computing image area data ($y_1$) and data ($\beta_1$) after the layout, and the registration roller clutch 618 by computing image area data ($x_1$) and data ($\alpha_1$) after the layout.

Computation of erase data will be described with reference to FIGS. 18A–18C.

Figure 18A:
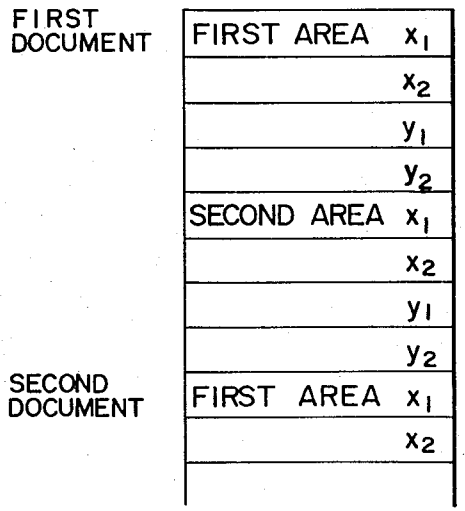
FIGS. 18A–18C show random access memory maps associated with image area data and erase data.
Figure 18B:
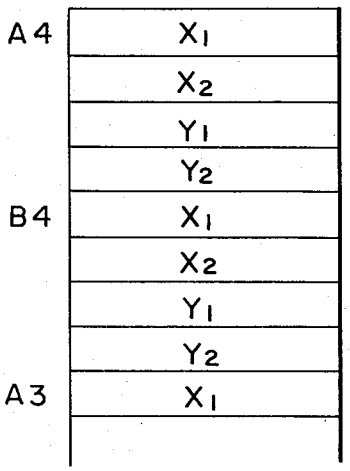
Figure 18C:
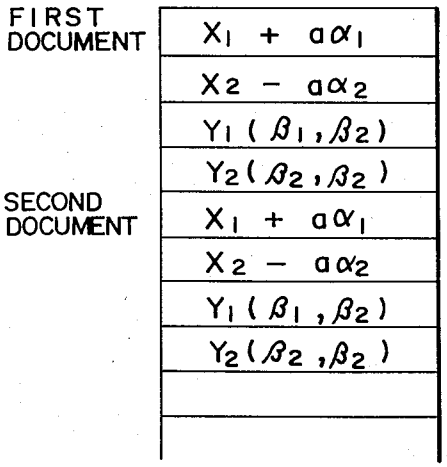

FIG. 18A shows image area data associated with different documents, which are entered through the area manipulating section 612, stored in specific addresses of the RAM 604. It should be noted that the number of image areas per document is not limited to two. FIG. 18B shows erase data applicable to usual copying which are stored in particular addresses of the ROM 603 size by size. Here, $x_1$ and $x_2$ are the numbers of clock pulses each representing a flashing timing of the erase unit, while $y_1$ and $y_2$ represent respectively the two halves of selected data associated with light emitting elements in the erase unit. Further, FIG. 18C shows computed erase data document by document; a represents the number of clock pulses per unit length of $\alpha_1$, and $Y_1(\beta_1, \beta_2)$ and $Y_2(\beta_1, \beta_2)$ represent respectively the two halves of erase element selection data which have been modified by $\beta_1$ and $\beta_2$.

A displacement of the optical axis is produced by $R(\beta_1-y_1)$ and the value R depends upon the zoom magnification during copying of the associated image area. An "on" timing of the registration roller clutch 618 is expressed as a $(\alpha_1-x_1)+Z$, where a is the number of clock pulses per unit length of $\alpha_1$ and Z, the number of clock pulses associated with the "on" timing of the clutch 618 in a usual copy mode. In the case where a plurality of developing units are each assigned to a particular color, the development drive clutch is controlled on and off at timings which depend upon which one of the developinig units has been selected and, also, one of the developing units which is associated with an inputted color is selected. The detention tray sheet feed clutch is driven at such timings that when an even image area, as distinguished from odd ones, is to be copied, the clutch causes a sheet loaded in the associated tray to be fed. The reference numerals 620–622 in FIG. 16 designate resistors and a photointerrupter adapted to generate clock pulses by sensing notches which are provided radially in a disk, which rotates in synchronism with the drum 9. The operating timings of the copier are controlled based on the number of those pulses.

Figure 19:
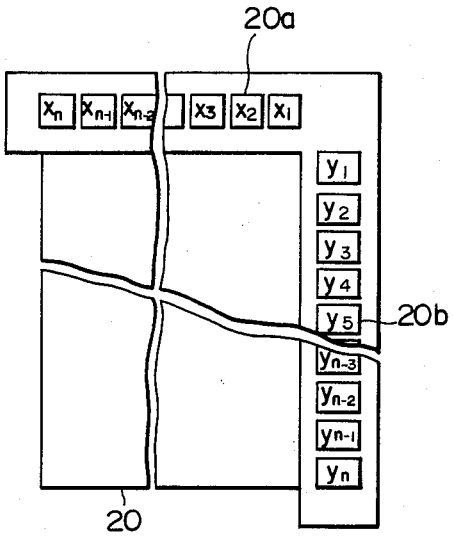
FIG. 19 is a plan view of an exemplary document table.

Referring to FIG. 19, the document table 20 and the x-axis scale **20*a* and y-axis scale 20*b* are shown. Any desired area can be specified by manipulating the left-shift, right-shift, up-shift and down-shift keys 6904–6907 in the area manipulating section shown in FIG. 7 and the ten keys 34 in the operating section shown in FIG. 4, each referencing the numerals provided on the scales 20*a* and 20*b*. First, the edit start key 6901 in the area manipulating section is depressed and, then, either the left-shift key 6906 or the right-shift key 6907 adapted to mark a position on the x-axis. Any one of the keys 6906 and 6907 may be depressed as desired at the initial address setting. Thereafter, the ten keys 34 are selectively depressed to mark a position of a desired area on the x-axis and, then, the up-shift and down-shift keys 1904 and 6905 are selectively manipulated in combination with the ten keys 34 to mark a position of the desired area on the y-axis. Such manipulation of the shift keys and ten keys for marking an address is repeated four times in total to specify a particular area to edit. After the editing operation, the edit end key 6902** will be depressed.

Figure 21:
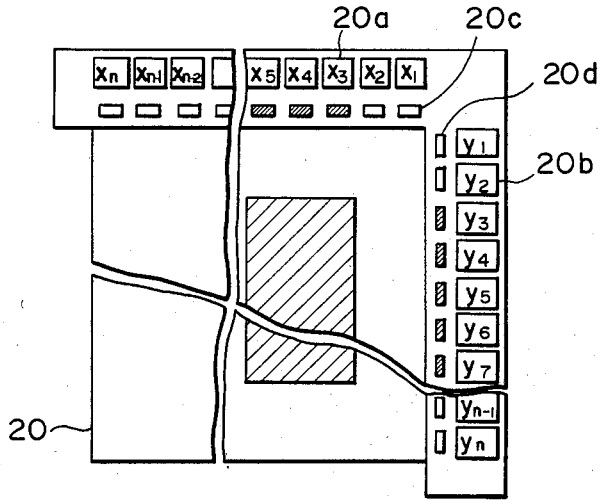

In the case of numerals on the scales plus position display elements, on the other hand, depression of the edit start key 6901 is followed by depression of the left-shift, right-shift, up-shift and down-shift keys 6904–6907 for determining specific positions on the x- and y-axes. The left-shift key 6904 is depressed either continuously or in an on-off fashion to shift the x-axis. While any of the shift keys are depressed, the LEDs **20*c* or 20*d* which constitute the position display elements are sequentially turned on one at a ime. Thereafter, either the up-shift key 6904 or the down-shift key 6905 is depressed to move the y-axis in place of the x-axis. Such manipulation for marking an address is repeated four times to define four addresses on the x- and y-axes. Again, the edit end key 6902 will be depressed at the end of the editing operation. Depression of the key 6902 turns the display mode of the position display elements from the point display to an x- and y-axes area display as shown in FIG. 21**.

Figure 22A:
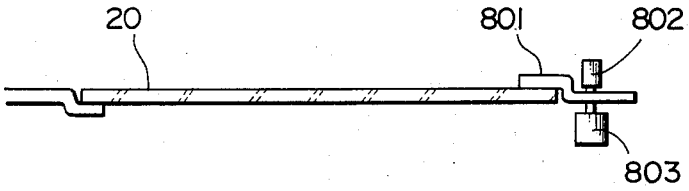
FIGS. 22A and 22B show in a section and a plan view, respectively, another example of the document table.
Figure 22B:
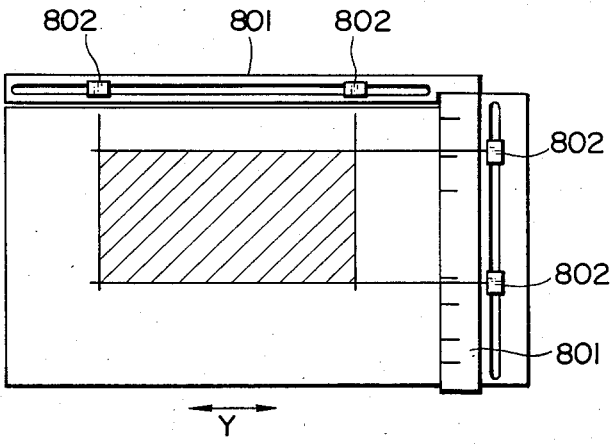
Figure 23:
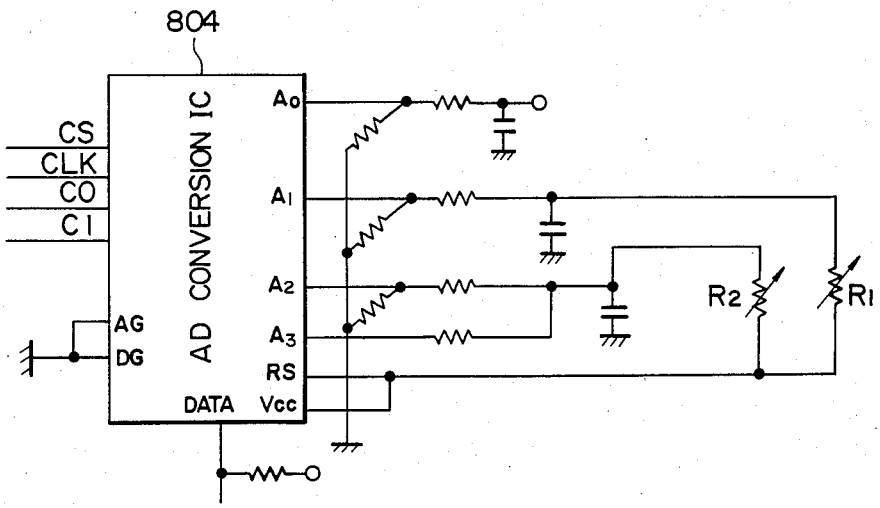
FIG. 23 is a circuit diagram of an analog-to-digital converter installed in an image area input section.
Figure 24:
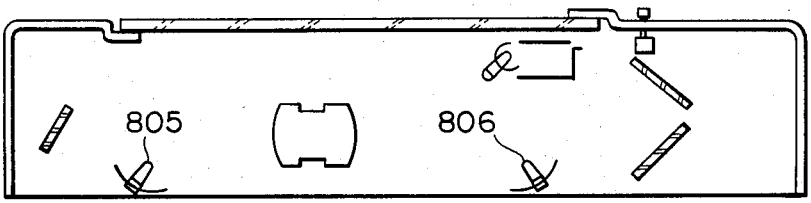
FIG. 24 shows an example of a document transmission type backlight illumination device.

Referring to FIGS. 22A and 22B, another example of the document table 20 is shown in a vertical section and a plan view. As shown, the document table 20 is provided with scales 801 adapted for use as a reference for positioning a document, knobs 802 associated with the scales 801, and slidable variable resistors 803. Two of the knobs 802 are arranged along the x-axis and the other two along the y-axis. In the illustrated condition, the hatched area represents a particular image area to edit. FIG. 23 shows an exemplary A-D converter 804 which serves to convert changes in the resistance of the variable resistors 803 which are associated with the two knob 802, respectively. Each variable resistor 803 may be mechanically connected to its associated knob by a wire, gear or the like. An example of a document transmission type backlight illuminating device is shown in FIG. 24. In FIG. 24, the reference numerals 805 and 806 designate lamps. It will be seen that in accordance with this particular example only four variable resistors suffice to mark an image area in fine pitches and, in addition, a particular image area of a document can be specified while setting a document on a document table, offering excellent operationability.

Referring to FIG. 25, a face of a document which is to be duplicated is shown. A desired area A of the document is represented by distances $x_1y_1$, $x_2y_1$, $x_1y_2$ and $x_2y_2$ from the coordinate 0. The document is dimensioned $1x \times 1y$. The specified area of the document is entered through the matrix switch groups which are arranged on the pressure-sensitive sheet 67 as shown in FIG. 9. In the event of copying, the document is laid on a document table; the prerequisite is that the desired image information be located to face the document table 20. In this instance, since the image surface is faced upward, the data read by the area input device have to be converted in order that a copy of the marked area may be provided by an actual copying procedure. Data conversion has to be performed in matching relation with various conditions particular to a machine such as an orientation of a document, i.e., vertical or horizontal orientation of a format A4, and a copy size in the event of magnifications other than $\times 1$.

As a typical and simplest example, conversion from the front face of a document to the back face will be described. FIG. 26 represents a case of $\times 1$ magnification and in which a document is oriented in the same direction on an area marking device and a document table. In FIG. 26, a document is shown at left in an orientation on an area marking device and at right in an orientation on a document table. What is required in this condition is simply converting the values representative of a marked area associated with the front surface to those associated with the back surface. Specifically, as shown in FIG. 27, the microcomputer 600 processes marked area data $x_1y_1$, $x_2y_2$, $x_1y_2$ and $x_2y_2$ and those document size data $x_0y_0$, $x_{lx}y_0$, $x_0y_{lx}$ and $x_{lx}y_{lx}$ which are entered through the area manipulating section 612 of FIG. 16 and, based on the result, the glowing timing and glowing position of the erase unit 615 are controlled via the I/O interface 613 and driver 614. Upon displacement, computation will also be performed using constants associated with reduction or enlargement.

Figure 28:
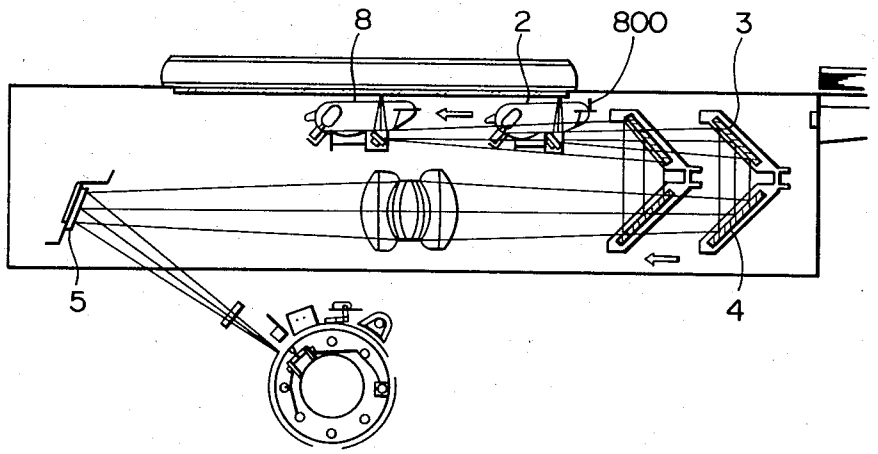
FIG. 28 shows optics surrounding an image sensor.

While the size data representative of a document has been shown and described as being read by use of a marking board, various other approaches are possible for the same purpose. For example, a sensor (not shown) may be associated with the ADF 1 to read the width and length of a document or, alternatively, a sensor 800 shown in FIG. 28 may be used to prescan a document to sense the length of the document. Particularly, concerning a copier in which documents are laid in the same orientation, it is possible to determine a document size by sensing only one of longitudinal and lateral dimensions of a document. In this manner, a particular area of a document to be edited can easily be marked with an image surface of the document faced upward.

FIGS. 29A–29D, 30A–30D and 31 are useful to describe the purport of the present invention in more detail, backing up FIGS. 6A–6G. In these drawings, concerning the label **1-*a*, "1**" represents a document number, and "b" the order of input of a particular one of a plurality of regions which are picked up from the document. This holds true with the other labels.

Figures 29A, 29B, 29C, 29D:
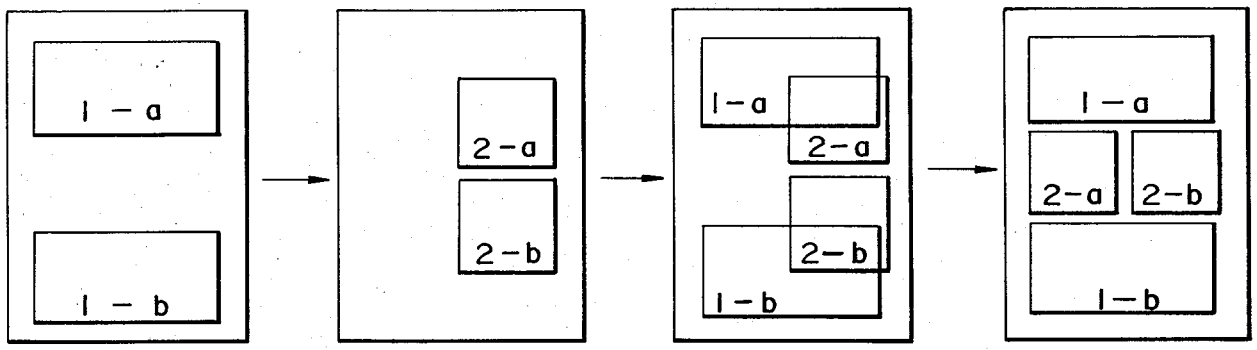
FIGS. 29A–29D, 30A–30D and 31 each represent correspondence between documents and colors for display.

Referring to FIGS. 29A–29D, there is shown a case wherein associating document numbers with colors for display is most effective. In FIG. 29A, two areas **1-*a* and 1-*b* are shown which are extracted from the first document. In FIG. 29B, two areas 2-*a* and 2-*b* are extracted from the second document. In FIGS. 29A and 29B, the areas 1-*a* and 1-*b* may be displayed in red and the areas 2-*a* and 2-*b* in blue by way of example. In FIG. 29C, the marked areas shown in FIGS. 29A and 29B are displayed at the same time on the same screen; the colors assigned one-to-one correspondence to the documents will facilitate rearrangement of the combined areas. Further in FIG. 29D, an exemplary arrangement provided by editing is shown in which the areas 2-*a* and 2-*b* extracted from the second document are inserted between the areas 1-*a* and 1-*b***.

Figure 20:
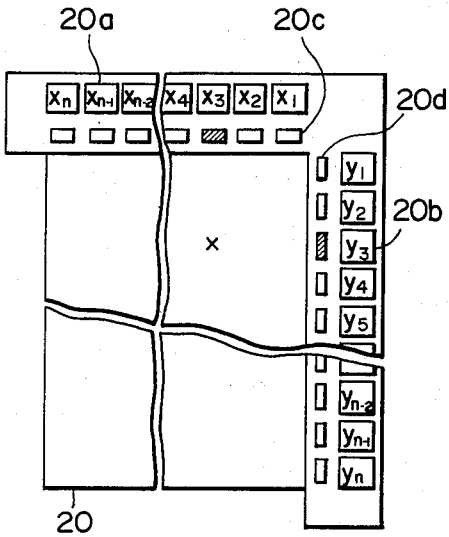
FIGS. 20 and 21 show a manner of display of a specified image area which is implemented by lighting.
Figure 30D:
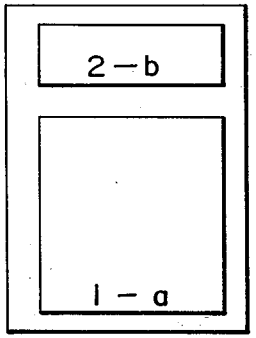
Figure 30C:
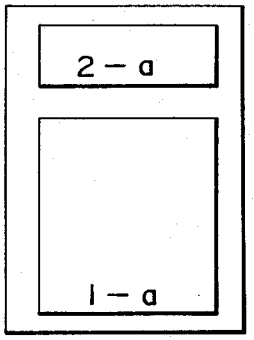
Figure 30B:
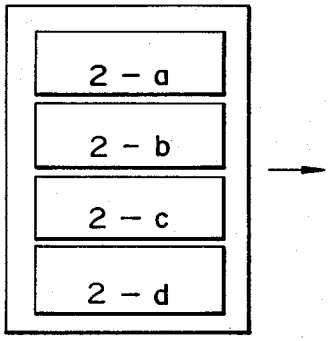
Figure 30A:
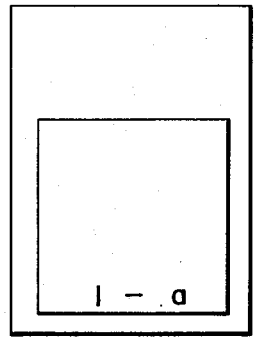

Referring to FIGS. 30A–30D, there is shown an example in which associating the orders of input of a plurality of areas, which are picked up from a single document, with colors for display is most effective. In FIG. 30A, a single area **1-*a* is extracted from the first document which may a descriptive part of a handbook and displayed in red, for example. In FIG. 30B, a plurality of areas 2-*a* to 2-*d* are extracted from the second document which may be addresses and displayed respectively in red, orange, yellow and yellow-green, for example. The areas shown in FIGS. 20A and 30B may be arranged as shown in FIGS. 30C and 30D**; the areas picked up from the second documents are sequentially combined with the area of the first document, the sequentially changing colors facilitating perception of the whole layout. Assigning different colors to different areas of a document according to the input order will also prove effective when it is desired to edit the n-th input areas of a plurality of documents.

Figure 31:
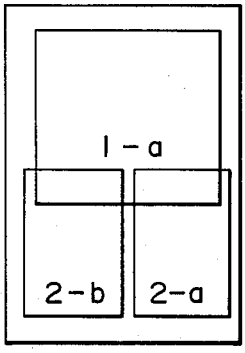

Referring to FIG. 31, there is shown an example in which colors for display are associated with the priority order such that the greatest effect is attainable when priority order exists among desired document areas. For example, **1-*a* represents a descriptive part extracted from the first document, while 2-*a* and 2-*b* are drawings which are extracted from the second document and associated with the descriptive part for reference purpose. In this case, since the reference drawings are merely adapted to facilitate an understanding of the description, they will sufficiently play their role even if partly covered with the descriptive part. In this condition, the priority key will be depressed to indicate that the area 1-*a* has priority over the other areas 2-*a* and 2-*b*; the area 1-*a* will be displayed in a color different from those of the areas 2-*a* and 2-*b*, e.g. red. In this particular situation, the areas 2-*a* and 2-*b*** will be displayed in an ordinary color.

As described above, since the display colors are matched with the priority orders of copying, one can confirm at a glance which one of overlapping image areas will be copied (one area with priority will be throughly copied, while that part of the other area which is overlapping the former will left uncopied). In addition, when a plurality of marked areas of a single document are entered, they are displayed in colors which are indicative of their input orders. Such allows the input order of any prticular area to be seen with ease and, thereby, facilitates editing work of the kind which replaces only a limited part of the entire information. Further, the all the n-th input image areas extracted from different documents can be edited at a look.

Figure 32A:
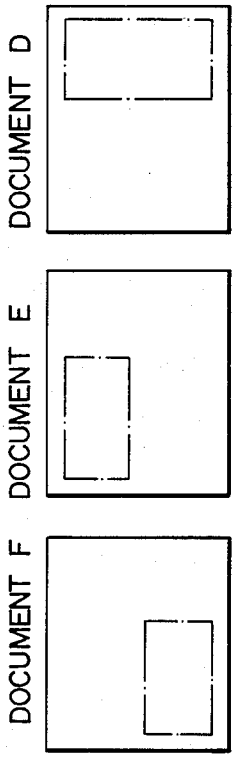
FIG. 32A shows documents to be edited and FIG. 32B, editing formats.
Figure 32B:
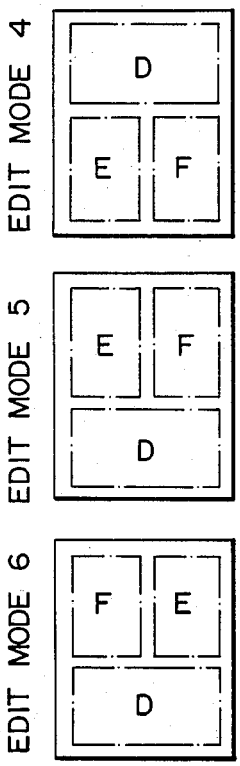

Reference will be made to FIGS. 32A and 32B for describing an operation flow in accordance with the present invention. FIG. 32A shows documents D–F each being marked to define a specific area, while FIG. 32B shows editing modes 4–6. The operation proceeds in the following sequence.

(1) The marked area of the document D is inputted.

(2) The marked area of the document E is inputted.

(3) The marked area of the document F is inputted.

(4) Data representative of the editing mode 4 is inputted.

(5) Data representative of the editing mode 5 is inputted.

(6) Data representative of the editing mode 6 is inputted.

(7) A content of the document D as specified by the editing mode 4 is copied and the resulting copy is stored in the detention tray.

(8) A content of the document D as specified by the editing mode 5 is copied and the resulting copy is stored in the detention tray.

(9) A content of the document D as specified by the editing mode 6 is copied and the resulting copy is stored in the detention tray.

(10) The editing mode 4 copy is fed out of the tray, it is superposed on a content of the document E as specified by the editing mode 4 to copy the latter, and the resulting copy is returned again to the detention tray.

(11) The editing mode 5 copy is fed out of the tray, it is superposed on a content of the document E as specified by the editing mode 5 to copy the latter, and the resulting copy is returned again to the detention tray.

(12) The editing mode 6 copy is fed out of the tray, it is superposed on a content of the document E as specified by the editing mode 6 to copy the latter, and the resulting copy is returned again to the detention tray.

(13) The editing mode 4 copy is fed out of the tray, it is superposed on a content of the document F as specified by the editing mode 4, and the resulting copy is discharged.

(14) The editing mode 5 copy is fed out of the tray, it is superposed on a content of the document F as specified by the editing mode 5 to copy the latter, and the resulting copy is discharged.

(15) The editing mode 6 copy is fed out of the tray, it is superposed on a content of the document F as specified by the editing mode 6 to copy the latter, and the resulting copy is discharged.

As described above, a plurality of different editing contents are entered at the same time and copied in a continuous manner. Such reduces the frequency of replacement of documents and, thereby, enhances operationability.

Figures 33A, 33B, 33C:
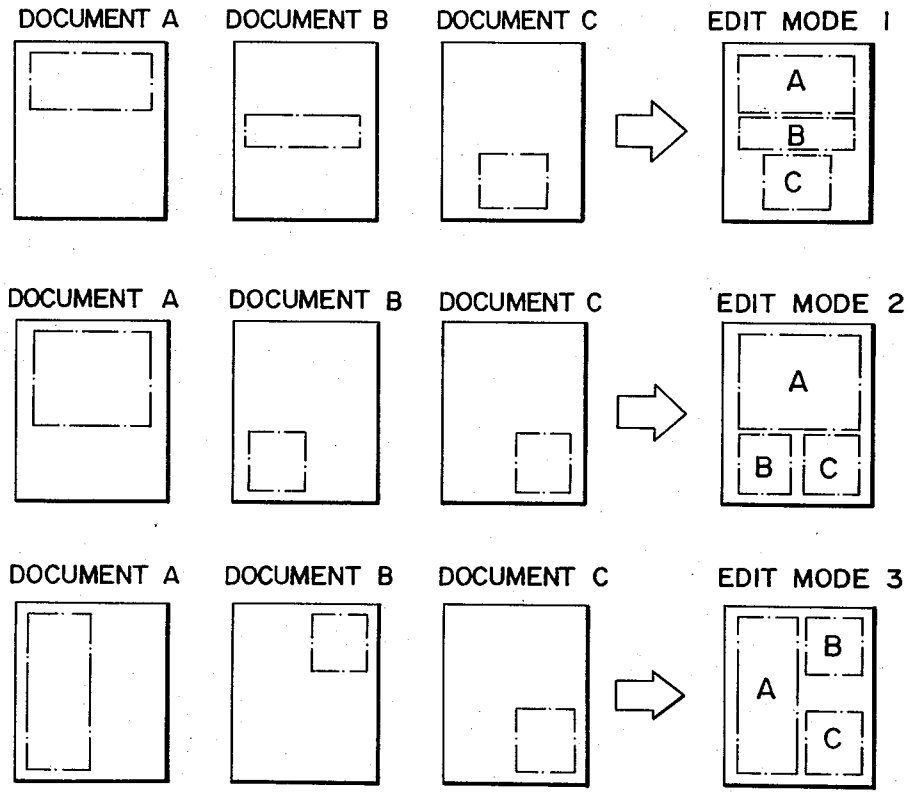
FIGS. 33A–33C show respectively procedures for editing documents A, B and C in formats 1, 2 and 3.

Another operation flow will be described with reference to FIGS. 33A–33C.

(1) Marked areas (three kinds) of a document A are inputted.

(2) Marked areas (three kinds) of a document B are inputted.

(3) Marked areas (three kinds) of a document C are inputted.

(4) The content of the document A associated with an editing mode 1 is copied and the resulting copy is stocked in the detention tray.

(5) The content of the document A associated with an editing mode 2 is copied and the resulting copy is stocked in the detention tray.

(6) The content of the document A associated with an editing mode 3 is copied and the resulting copy is stocked in the detention tray.

(7) The editing mode 1 copy is fed out of the tray, it is superposed on the content of the document B associated with the editing mode 1 to copy the latter, and then the resulting copy is returned again to the tray.

(8) The editing mode 2 copy is fed out of the detention tray, it is superposed on the content of the document B associated with the editing mode 2 to copy the latter, and the resulting copy is returned again to the tray.

(9) The editing mode 3 copy is fed out of the detention tray, it is superposed on the content of the document B associated with the editing mode 3 to copy the latter, and the resulting copy is returned again to the tray.

(10) The editing mode 1 copy is fed out of the detention tray, it is superposed on the conent of the document C associated with the editing mode 1 to copy the latter, and the resulting copy is discharged.

(11) The editing mode 2 copy is fed out of the detention tray, it is superposed on the content of the document C associated with the editing mode 2, and the resulting copy is discharged.

(12) The editing mode 3 copy is fed out of the detention tray, it is superposed on the content of the document C associated with the editing mode 3, and the resulting copy is discharged.

As described above, a plurality of editing contents are entered at the same time and then continuously copied so as to improve the operationability. In addition, the copies are guided to independent stockers on the basis of an editing conent, thereby eliminating the need for the subsequent sorting work.

Figure 34:
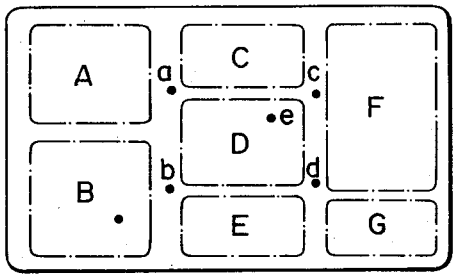
FIG. 34 shows a document having discrete image areas.

Referring to FIG. 34, a document having marked image areas A–G is shown. The image areas A–G may be selectively copied in two different modes, for example. The first mode is such that only the area D is copied with the other areas A, B, C, E, F and G erased, while the second mode is such that the areas A, B, C, E, F and G are copied with the area D erased. This principle is applicable to a case wherein a part of the second document is to fill the area D which was erased by the first copying operation; typically, inserting an address and other data into a part of a standard letter.

Figure 35B:
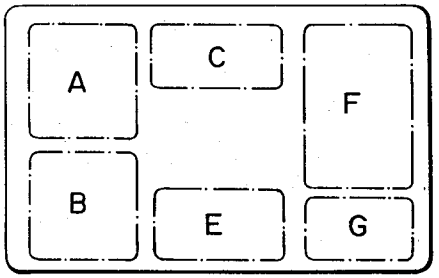
FIGS. 35A and 35B show different image areas selected.
Figure 35A:
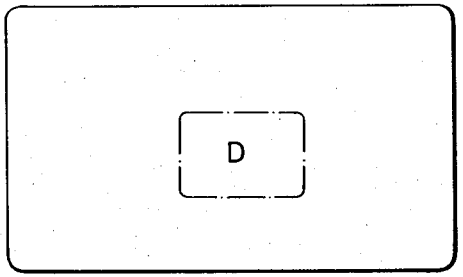

A copy area provided by the first copy job in the first-mentioned mode is shown in FIG. 35A, and copy areas provided by the first copy job in the second-mentioned mode are shown in FIG. 35B.

Any of the image areas is specified in terms of four points a, b, c and d which delimite the area D. Further, in the first-mentioned mode, a point e which is located inside of the area abcd will be marked to specify the region D and, in the second-mentioned mode, a point f located outside of the area abcd will be marked to specify the areas other than D. Alternatively, a condition in which none of the points e and f has been marked may considered as representing the first-mentioned mode The above-discussed specifying principle may be implemented by the keys which are arranged on the control panel shown in FIG. 4.

Figure 36A:
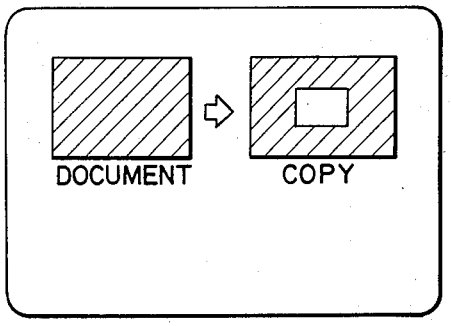
FIGS. 36A–36C show the same marked area but in different modes of display.
Figure 36B:
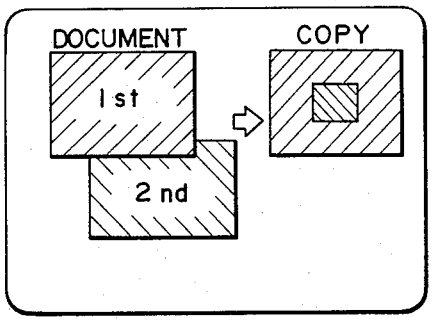
Figure 36C:
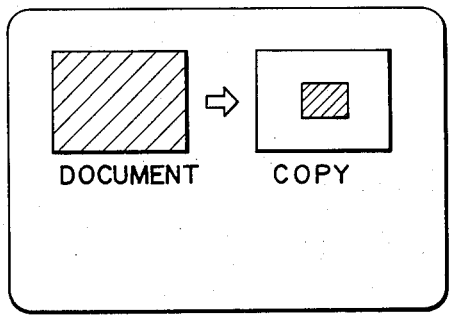

Further, the specified area may be displayed on the CRT as shown in FIGS. 36A–36C. FIG. 36A demonstrates omission of a part of a document, FIG. 36B combination of two documents, and FIG. 36C omission of a peripheral part of an image.

As described above, partial omission of specified areas, combination of documents and even omittion of a peripheral region can be freely accomplished merely by marking at least four points and at least one point which is located inside or outside of the area delimited by the four points, thereby enhancing operationability.

Various modifications will become possible for those skilled in the art after receiving the teachings of the present disclosure without departing from the scope thereof.

What is claimed is:

1. A copier having an image editing function, comprising:

a photoconductive element and a charger for depositing a uniform electrostatic charge on said photoconductive element;

an illuminating and exposing optical device for projecting an optical image of a document onto the photoconductive element;

a developing device for developing an image provided on a surface of the photoconductive element;

an erasing device for selectively erasing the image provided on the surface of the photoconductive element;

a sheet feeding device for feeding a transfer sheet;

a detaining device for temporarily detaining the transfer sheet to which the image developed by the developing device has been transferred;

a discharging device for discharging the transfer sheet to which the image developed by the developing device has been transferred;

a discharge path extending from a predetermined transfer station to said discharging device;

a communication path for providing communication between said transfer position and the detaining device;

a selector for selecting one of said discharge path and said communication path;

an image inputting device for inputting an image carried on a document;

a display device for displaying an input condition; and a control device for causing a copying operation to be started after specifying a desired area of a first document and, during said copying operation, specifying a desired area of a second document and, thereby, repeatedly specifying desired areas of a plurality of documents.

2. A copier having an image editing function, comprising:

a photoconductive element and a charger for depositing a uniform electrostatic charge on said photoconductive element;

an illuminating and exposing optical device for projecting an optical image of a document onto the photoconductive element;

a developing device for developing an image provided on a surface of the photoconductive element;

an erasing device for selectively erasing the image provided on the surface of the photoconductive element;

a sheet feeding device for feeding a transfer sheet;

a detaining device for temporarily detaining the transfer sheet to which the image developed by the developing device has been transferred;

a discharging device for discharging the transfer sheet to which the image developed by the developing device has been transferred;

a discharge path extending from a predetermined transfer station to said discharging device;

a communication path for providing communication between said transfer position and the detaining device;

a selector for selecting one of said discharge path and said communication path;

an image inputting device for inputting an image carried on a document;

a display device for displaying an input condition; and a control device for causing desired areas of at least one document to be specified and then completely edited while displaying said desired areas on said display device for confirmation and then causing a copying operation to be started.

3. A copier having an image editing function, comprising:

a photoconductive element and a charger for depositing a uniform electrostatic charge on said photoconductive element;

an illuminating and exposing optical device for projecting an optical image of a document onto the photoconductive element;

a developing device for developing an image provided on a surface of the photoconductive element;

an erasing device for selectively erasing the image provided on the surface of the photoconductive element;

a sheet feeding device for feeding a transfer sheet;

a detaining device for temporarily detaining the transfer sheet to which the image developed by the developing device has been transferred;

a discharging device for discharging the transfer sheet to which the image developed by the developing device has been transferred;

a discharge path extending from a predetermined transfer station to said discharging device;

a communication path for providing communication between said transfer position and the detaining device;

a selector for selecting one of said discharge path and said communication path;

an image inputting device for inputting an image carried on a document;

a display device for displaying an input condition; and a control device constructed to operate such that where a first to an n-th documents are to be edited and when the documents partly overlap each other in an arrangement on a transfer sheet, a priority order is assigned to the documents so that overlapping portions of the documents are copied according to the priority order.

4. A copier having an image editing function, comprising:

a photoconductive element and a charger for depositing a uniform electrostatic charge on said photoconductive element;

an illuminating and exposing optical device for projecting an optical image of a document onto the photoconductive element;

a developing device for developing an image provided on a surface of the photoconductive element;

an erasing device for selectively erasing the image provided on the surface of the photoconductive element;

a sheet feeding device for feeding a transfer sheet;

a detaining device for temporarily detaining the transfer sheet to which the image developed by the developing device has been transferred;

a discharging device for discharging the transfer sheet to which the image developed by the developing device has been transferred;

a discharge path extending from a predetermined transfer station to said discharging device;

a communication path for providing communication between said transfer position and the detaining device;

a selector for selecting one of said discharge path and said communication path;

an image inputting device for inputting an image carried on a document;

a display device for displaying an input condition; and a control device constructed to operate such that where a first to an n-th documents are to be edited and when the documents partly overlap each other in an arrangement on a transfer sheet, a content of one of the documents which is to be copied is selectable.

5. A copier having an image editing function, comprising:

a photoconductive element and a charger for depositing a uniform electrostatic charge on said photoconductive element;

an illuminating and exposing optical device for projecting an optical image of a document onto the photoconductive element;

a developing device for developing an image provided on a surface of the photoconductive element;

an erasing device for selectively erasing the image provided on the surface of the photoconductive element;

a sheet feeding device for feeding a transfer sheet;

a detaining device for temporarily detaining the transfer sheet to which the image developed by the developing device has been transferred;

a discharging device for discharging the transfer sheet to which the image developed by the developing device has been transferred;

a discharge path extending from a predetermined transfer station to said discharging device;

a communication path for providing communication between said transfer position and the detaining device;

a selector for selecting one of said discharge path and said communication path;

an image inputting device for inputting an image carried on a document;

a display device for displaying an input condition; and a control device for allowing a desired number of image editing areas to be set up.

6. A copier having an image editing function, comprising:

a photoconductive element and a charger for depositing a uniform electrostatic charge on said photoconductive element;

an illuminating and exposing optical device for projecting an optical image of a document onto the photoconductive element;

a developing device for developing an image provided on a surface of the photoconductive element;

an erasing device for selectively erasing the image provided on the surface of the photoconductive element;

a sheet feeding device for feeding a transfer sheet;

a detaining device for temporarily detaining the transfer sheet to which the image developed by the developing device has been transferred;

a discharging device for discharging the transfer sheet to which the image developed by the developing device has been transferred;

a discharge path extending from a predetermined transfer station to said discharging device;

a communication path for providing communication between said transfer position and the detaining device;

a selector for selecting one of said discharge path and said communication path;

an image inputting device for inputting an image carried on a document;

a display device for displaying an input condition; and a control device for causing a particular image area of a document to be specified by combined manipulation of keys for editing and ten keys for setting a number.

7. A copier having an image editing function, comprising:

a photoconductive element and a charger for depositing a uniform electrostatic charge on said photoconductive element;

an illuminating and exposing optical device for projecting an optical image of a document onto the photoconductive element;

a developing device for developing an image provided on a surface of the photoconductive element;

an erasing device for selectively erasing the image provided on the surface of the photoconductive element;

a sheet feeding device for feeding a transfer sheet;

a detaining device for temporarily detaining the transfer sheet to which the image developed by the developing device has been transferred;

a discharging device for discharging the transfer sheet to which the image developed by the developing device has been transferred;

a discharge path extending from a predetermined transfer station to said discharging device;

a communication path for providing communication between said transfer position and the detaining device;

a selector for selecting one of said discharge path and said communication path;

an image inputting device for inputting an image carried on a document;

a display device for displaying an input condition;

two scales for positioning a document which are provided on a document table perpendicularly to each other;

knobs positioned in the vicinity of said scales for defining a particular image area to be copied;

variable resistors associated respectively with said knobs;

an analog-to-digital converter for converting a variation of resistance of each of said variable resistors to a digital signal; and a control circuit for processing the digital signal, the erasing device being caused to glow at a timing and a position which are selected responsive to an output signal of said control circuit in correspondence with said defined image area.

8. A copier having an image editing function, comprising:

a photoconductive element and a charger for depositing a uniform electrostatic charge on said photoconductive element;

an illuminating and exposing optical device for projecting an optical image of a document onto the photoconductive element;

a developing device for developing an image provided on a surface of the photoconductive element;

an erasing device for selectively erasing the image provided on the surface of the photoconductive element;

a sheet feeding device for feeding a transfer sheet;

a detaining device for temporarily detaining the transfer sheet to which the image developed by the developing device has been transferred;

a discharging device for discharging the transfer sheet to which the image developed by the developing device has been transferred;

a discharge path extending from a predetermined transfer station to said discharging device;

a communication path for providing communication between said transfer position and the detaining device;

a selector for selecting one of said discharge path and said communication path;

an image inputting device for inputting an image carried on a document;

means for sensing a document size;

area defining means for defining a desired area of a document image; and a control unit for controling a glowing timing and a glowing position of the erasing device, which is controlled based on a result of computation which uses position information entered through said area defining means and a document size, in conformity to values associated with the defined area when the document is laid on the document table face down.

9. A copier having an image editing function, comprising:

a photoconductive element and a charger for depositing a uniform electrostatic charge on said photoconductive element;

an illuminating and exposing optical device for projecting an optical image of a document onto the photoconductive element;

a developing device for developing an image provided on a surface of the photoconductive element;

an erasing device for selectively erasing the image provided on the surface of the photoconductive element;

a sheet feeding device for feeding a transfer sheet;

a detaining device for temporarily detaining the transfer sheet to which the image developed by the developing device has been transferred;

a discharging device for discharging the transfer sheet to which the image developed by the developing device has been transferred;

a discharge path extending from a predetermined transfer station to said discharging device;

a communication path for providing communication between said transfer position and the detaining device;

a selector for selecting one of said discharge path and said communication path;

an image inputting device for inputting an image carried on a document;

a display device for displaying an input condition; and a control device constructed to operate such that where a plurality of image areas of each of documents which are entered through the image inputting device are to be edited while being displayed on the display device, the image areas are displayed according to an order or priority which is given to overlapping portions of images and entered through the image inputting device.

10. A copier having an image editing function, comprising:

a photoconductive element and a charger for depositing a uniform electrostatic charge on said photoconductive element;

an illuminating and exposing optical device for projecting an optical image of a document onto the photoconductive element;

a developing device for developing an image provided on a surface of the photoconductive element;

an erasing device for selectively erasing the image provided on the surface of the photoconductive element;

a sheet feeding device for feeding a transfer sheet;

a detaining device for temporarily detaining the transfer sheet to which the image developed by the developing device has been transferred;

a discharging device for discharging the transfer sheet to which the image developed by the developing device has been transferred;

a dishcarge path extending from a predetermined transfer station to said discharging device;

a communication path for providing communication between said transfer position and the detaining device;

a selector for selecting one of said discharge path and said communication path;

an image inputting device for inputting an image carried on a document;

a display device for displaying an input condition; and a control device constructed to operate such that when a plurality of image areas of each of documents which are entered through the image inputting device are to be displayed on the display device, a plurality of image areas of a same document are displayed in colors which are associated with an order of entry of the image areas.

11. A copier having an image editing function, comprising:

a photoconductive element and a charger for depositing a uniform electrostatic charge on said photoconductive element;

an illuminating and exposing optical device for projecting an optical image of a document onto the photoconductive element;

a developing device for developing an image provided on a surface of the photoconductive element;

an erasing device for selectively erasing the image provided on the surface of the photoconductive element;

a sheet feeding device for feeding a transfer sheet;

a detaining device for temporarily detaining the transfer sheet to which the image developed by the developing device has been transferred;

a discharging device for discharging the transfer sheet to which the image developed by the developing device has been transferred;

a discharge path extending from a predetermined transfer station to said discharging device;

a communication path for providing communication between said transfer position and the detaining device;

a selector for selecting one of said discharge path and said communication path;

an image inputting device for inputting an image carried on a document;

a display device for displaying an input condition; and a control device constructed to operate such that when a plurality of image areas of each of documents which are entered through said image inputting means are displayed on the display device, the image areas are displayed in colors which respectively are associated with the documents.

12. A copier having an image editing function, comprising:

a photoconductive element and a charger for depositing a uniform electrostatic charge on said photoconductive element;

an illuminating and exposing optical device for projecting an optical image of a document onto the photoconductive element;

a developing device for developing an image provided on a surface of the photoconductive element;

an erasing device for selectively erasing the image provided on the surface of the photoconductive element;

a sheet feeding device for feeding a transfer sheet;

a detaining device for temporarily detaining the transfer sheet to which the image developed by the developing device has been transferred;

a discharging device for discharging the transfer sheet to which the image developed by the developing device has been transferred;

a discharge path extending from a predetermined transfer station to said discharging device;

a communication path for providing communication between said transfer position and the detaining device;

a selector for selecting one of said discharge path and said communication path;

an image inputting device for inputting an image carried on a document;

a display device for displaying an input condition; and a control device constructed to operate such that a plurality of contents to be edited which comprise a desired combination of specified areas are allowed to be entered simultaneously and to be copied continuously.

13. A copier having an image editing function, comprising:

a photoconductive element and a charger for depositing a uniform electrostatic charge on said photoconductive element;

an illuminating and exposing optical device for projecting an optical image of a document onto the photoconductive element;

a developing device for developing an image provided on a surface of the photoconductive element;

an erasing device for selectively erasing the image provided on the surface of the photoconductive element;

a sheet feeding device for feeding a transfer sheet;

a detaining device for temporarily detaining the transfer sheet to which the image developed by the developing device has been transferred;

a discharging device for discharging the transfer sheet to which the image developed by the developing device has been transferred;

a dishcarge path extending from a predetermined transfer station to said discharging device;

a communication path for providing communication between said transfer position and the detaining device;

a selector for selecting one of said discharge path and said communication path;

an image inputting device for inputting an image carried on a document;

a display device for displaying an input condition; and a control device constructed to operate such that a plurality of image areas of a same document are entered and edited contents which comprise a desired combination of said image areas are allowed to be entered and to be copied continuously.

14. A copier having an image editing function, comprising:

a photoconductive element and a charger for depositing a uniform electrostatic charge on said photoconductive element;

an illuminating and exposing optical device for projecting an optical image of a document onto the photoconductive element;

a developing device for developing an image provided on a surface of the photoconductive element;

an erasing device for selectively erasing the image provided on the surface of the photoconductive element;

a sheet feeding device for feeding a transfer sheet;

a detaining device for temporarily detaining the transfer sheet to which the image developed by the developing device has been transferred;

a discharging device for discharging the transfer sheet to which the image developed by the developing device has been transferred;

a discharge path extending from a predetermined transfer station to said discharging device;

a communication path for providing communication between said transfer position and the detaining device;

a selector for selecting one of said discharge path and said communication path;

an image inputting device for inputting an image carried on a document;

a display device for displaying an input condition; and a control device for allowing a plurality of edited contents to be entered simultaneously and, after the plurality of edited contents have been continuously copied, causing transfer sheets to be stocked in different positions inside of a storing device on the basis of an edited content.

15. A copier having an image editing function, comprising:

a photoconductive element and a charger for depositing a uniform electrostatic charge on said photoconductive element;

an illuminating and exposing optical device for projecting an optical image of a document onto the photoconductive element;

a developing device for developing an image provided on a surface of the photoconductive element;

an erasing device for selectively erasing the image provided on the surface of the photoconductive element;

a sheet feeding device for feeding a transfer sheet;

a detaining device for temporarily detaining the transfer sheet to which the image developed by the developing device has been transferred;

a discharging device for discharging the transfer sheet to which the image developed by the developing device has been transferred;

a discharge path extending from a predetermined transfer station to said discharging device;

a communication path for providing communication between said transfer position and the detaining device;

a selector for selecting one of said discharge path and said communication path;

an image inputting device for inputting an image carried on a document;

a display device for displaying an input condition;

means for specifying a desired image area of a document responsive to inputs which are representative of at least four points;

means for allowing an interior and an exterior of said specified area to be selectively specified; and means for displaying the specified area while holding the specified area in correspondence with a copy image.

* * * * *